US011660866B2

(12) United States Patent
Miyagishi

(10) Patent No.: US 11,660,866 B2
(45) **Date of Patent: *May 30, 2023**

(54) LIQUID EJECTING HEAD AND LIQUID EJECTING APPARATUS

(71) Applicant: SEIKO EPSON CORPORATION, Tokyo (JP)

(72) Inventor: Akira Miyagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/805,279

(22) Filed: Jun. 3, 2022

(65) Prior Publication Data

US 2022/0288934 A1 Sep. 15, 2022

Related U.S. Application Data

(63) Continuation of application No. 17/167,386, filed on Feb. 4, 2021, now Pat. No. 11,400,711.

(30) Foreign Application Priority Data

Feb. 7, 2020 (JP) ..... JP2020-019425

(51) Int. Cl.
*B41J 2/14* (2006.01)

(52) U.S. Cl.
CPC ..... *B41J 2/14233* (2013.01); *B41J 2/14032* (2013.01); *B41J 2/1433* (2013.01); *B41J 2/14201* (2013.01); *B41J 2002/14241* (2013.01); *B41J 2202/11* (2013.01)

(58) Field of Classification Search
CPC ..... B41J 2/14233; B41J 2/14032; B41J 2/14201; B41J 2/1433; B41J 2002/14241; B41J 2202/11
See application file for complete search history.

(56) References Cited

U.S. PATENT DOCUMENTS 10,870,274 B2 12/2020 Tsukahara et al.
11,400,711 B2 * 8/2022 Miyagishi ..... B41J 2/14233
2013/0233939 A1 9/2013 Uezawa

FOREIGN PATENT DOCUMENTS

JP 2013-184372 A 9/2013

* cited by examiner

*Primary Examiner* — Geoffrey S Mruk
(74) *Attorney, Agent, or Firm* — Workman Nydegger

(57) ABSTRACT

The first nozzle channel includes a first portion including an end of the first nozzle channel and a second portion including another end of the first nozzle channel, and a width of the second portion in the second direction is larger than a width of the first portion in the second direction.

19 Claims, 27 Drawing Sheets

LIQUID EJECTING HEAD AND LIQUID EJECTING APPARATUS

The present application is a Continuation of U.S. patent application Ser. No. 17/167,386, filed Feb. 4, 2021, which is now U.S. Pat. No. 11,400,711, which is based on, and claims priority from, JP Application Serial Number 2020-019425, filed Feb. 7, 2020, the disclosures of which are hereby incorporated by reference herein in their entirety.

BACKGROUND

1. Technical Field

The present disclosure relates to liquid ejecting heads and liquid ejecting apparatuses.

2. Related Art

Liquid ejecting heads that eject liquid, such as ink, from multiple nozzles have been proposed. For example, JP-A-2013-184372 discloses a liquid ejecting head that ejects liquid from nozzles by changing the pressure of the liquid in pressure chambers with piezoelectric elements. This liquid ejecting head includes multiple nozzle channels each having a nozzle. The multiple nozzle channels are arrayed in a predetermined direction.

In known liquid ejecting heads, vibration in one of two adjacent nozzle channels propagates to the other nozzle channel to decrease the ejection characteristics of the ink through the nozzle of the other nozzle channel, possibly causing so-called structural crosstalk.

If the resistance of the nozzle channels increases, it takes much time to supply the liquid, possibly causing ejection failure and increasing the recording time.

SUMMARY

Accordingly, it is an object of the present disclosure to reduce the occurrence of structural crosstalk while preventing an increase in the resistance of the nozzle channels.

A liquid ejecting head according to an aspect of the present disclosure includes a first pressure chamber that extends in a first direction and that applies pressure to liquid, a second pressure chamber that extends in the first direction and that applies pressure to the liquid, a first nozzle channel that extends in the first direction and that includes a first nozzle that ejects the liquid. a first communication channel that extends in a second direction intersecting the first direction and that communicates between the first pressure chamber and the first nozzle channel, and a second communication channel that extends in the second direction and that communicates between the second pressure chamber and the first nozzle channel, wherein the first nozzle channel includes a first portion including an end of the first nozzle channel and a second portion including another end of the first nozzle channel, and a width of the second portion in the second direction is larger than a width of the first portion in the second direction.

DESCRIPTION OF EXEMPLARY EMBODIMENTS

First Embodiment

Figure 1:
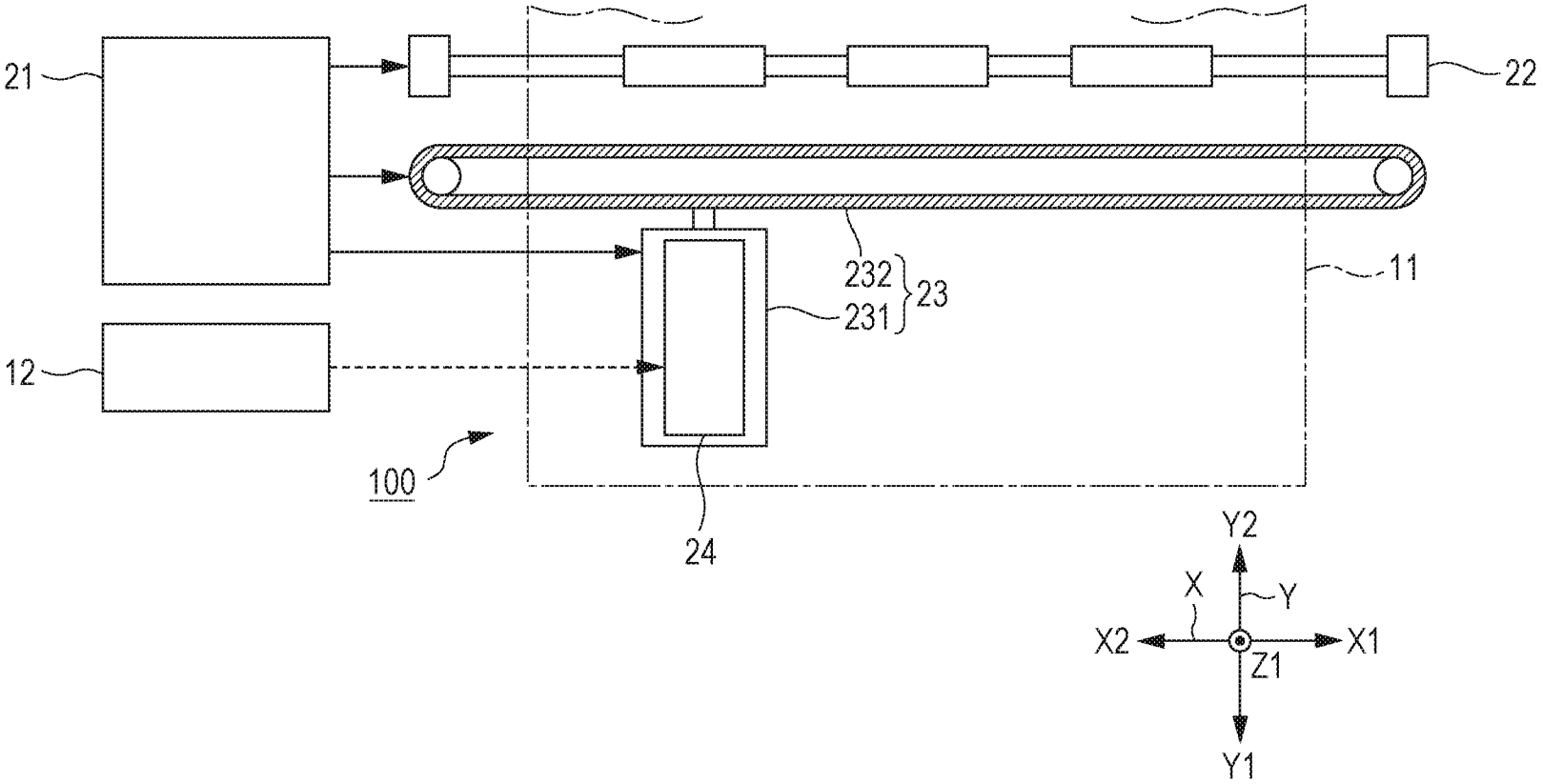
FIG. 1 is a schematic diagram illustrating a partial configuration example of a liquid ejecting apparatus according to a first embodiment.

In the following description, assume X-axis, Y-axis, and Z-axis that intersect one another. The X-axis, the Y-axis, and the Z-axis are common in all the drawings illustrated in the description. As shown in FIG. 1, a direction along the X-axis as viewed from any point is expressed as X1-direction, and a direction opposite to the X1-direction is expressed as X2-direction. The X1-direction corresponds to "first direction". Likewise, directions opposite to each other from any point along the Y-axis are expressed as Y1-direction and Y2-direction. The Y2-direction corresponds to "third direction". Directions opposite to each other from any point along the Z-axis are expressed as Z1-direction and Z2-direction. The Z1-direction corresponds to "second direction". An X-Y plane including the X-axis and the Y-axis corresponds to a horizontal plane. The Z-axis is an axis along the vertical direction, and the Z2-direction corresponds to a downward direction in the vertical direction.

FIG. 1 is a schematic diagram illustrating a partial configuration example of a liquid ejecting apparatus 100 according to this embodiment. The liquid ejecting apparatus 100 is an ink jet printer that ejects droplets of liquid, such as ink, onto a medium 11. An example of the medium 11 is printing paper. The medium 11 may be a print target of any material, such as resin film or cloth.

The liquid ejecting apparatus 100 includes a liquid container 12. The liquid container 12 stores ink. The liquid container 12 may be a cartridge that can be detached from the liquid ejecting apparatus 100, a bag-like ink pack made of flexible film, or an ink tank that can be refilled with ink. Any kind of ink can be stored in the liquid container 12.

As shown in FIG. 1, the liquid ejecting apparatus 100 includes a control unit 21, a transporting mechanism 22, a moving mechanism 23, and a liquid ejecting head 24. The control unit 21 includes a processing circuit, such as a central processing unit (CPU) or a field programmable gate array (FPGA), and a storage circuit, such as a semiconductor memory, and controls the elements of the liquid ejecting apparatus 100, such as the ejecting operation of the liquid ejecting head 24. The control unit 21 is an example of "control section".

The transporting mechanism 22 transports the medium 11 along the Y-axis based on the control of the control unit 21. The moving mechanism 23 moves the liquid ejecting head 24 back and forth along the X-axis based on the control of the control unit 21. The moving mechanism 23 includes a substantially box-shaped transporter 231 housing the liquid ejecting head 24 and an endless transport belt 232 to which the transporter 231 is fixed. This embodiment may employ a configuration in which multiple liquid ejecting heads 24 are mounted in the transporter 231 and a configuration in which the liquid container 12 is mounted in the transporter 231 together with the liquid ejecting head 24.

The liquid ejecting head 24 ejects the ink supplied from the liquid container 12 onto the medium 11 through each of the multiple nozzles based on the control of the control unit 21. The liquid ejecting head 24 ejects the ink onto the medium 11 in parallel with the transportation of the medium 11 by the transporting mechanism 22 and repeated reciprocal motion of the transporter 231 to form an image on the surface of the medium 11.

Figure 2:
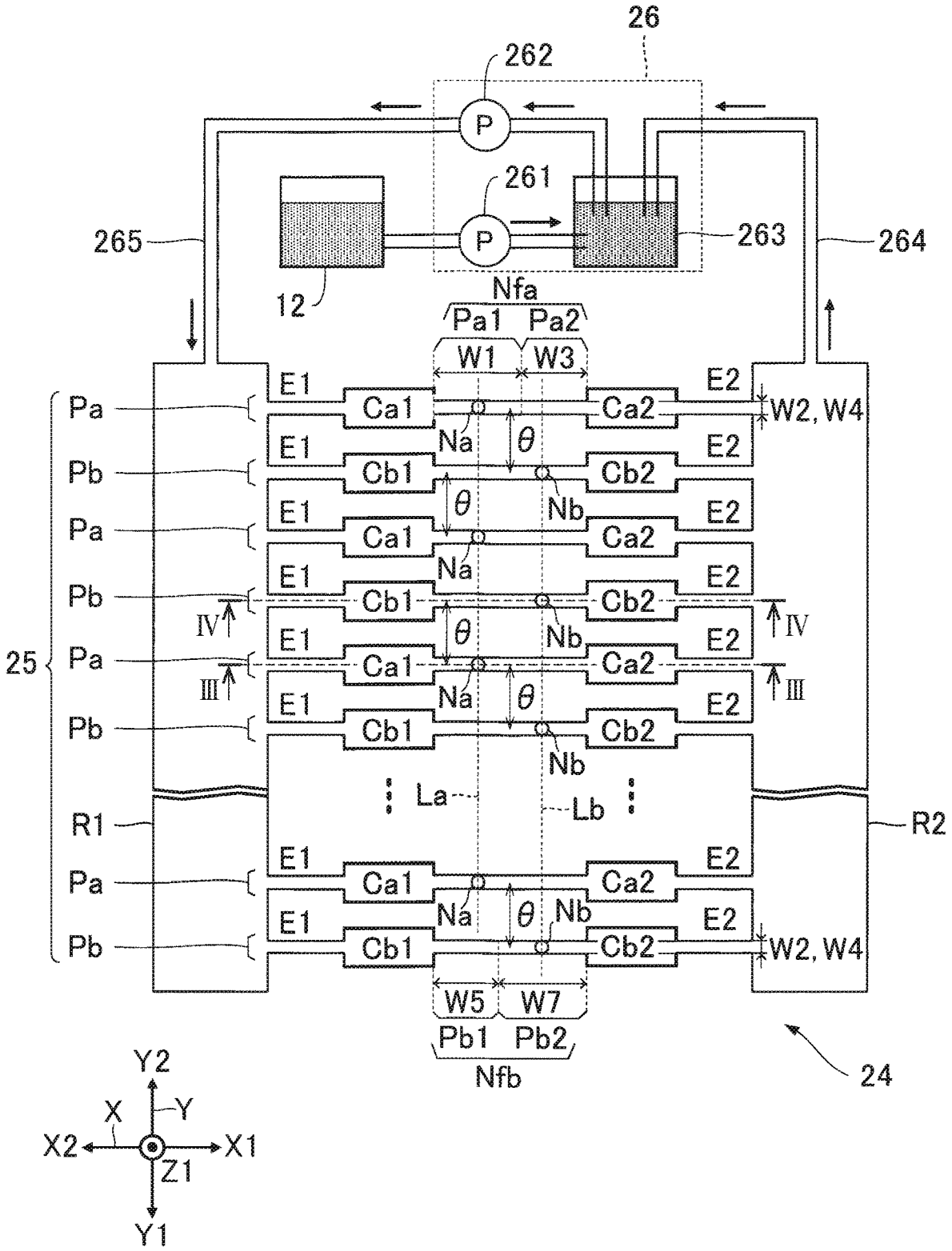
FIG. 2 is a schematic diagram illustrating a channel structure in a liquid ejecting head.

FIG. 2 is a schematic diagram illustrating a channel structure in the liquid ejecting head 24 as viewed in the Z-axis. Multiple nozzles Na and multiple nozzles Nb are provided on the surface of the liquid ejecting head 24 facing the medium 11, as shown in FIG. 2. The nozzles Na and the nozzles Nb are arrayed along the Y-axis. Each of the nozzles Na and the nozzles Nb ejects ink in the Z-axis direction. Accordingly, the Z-axis direction corresponds to a direction in which ink is ejected through each of the nozzles Na and the nozzles Nb. The nozzle Na is an example of "first nozzle", and the nozzle Nb is an example of "second nozzle".

As shown in FIG. 2, the nozzles Na constitute a first nozzle array La, and the nozzles Nb constitute a second nozzle array Lb. The first nozzle array La is an aggregation of the multiple nozzles Na arrayed linearly along the Y-axis. Likewise, the second nozzle array Lb is an aggregation of the multiple nozzles Nb arrayed linearly along the Y-axis. The first nozzle array La and the second nozzle array Lb are disposed in parallel in the X-axis, with a space therebetween, as shown in FIG. 2. The position of each nozzle Na in the Y-axis direction and the position of each nozzle Nb in the Y-axis direction differ. As shown in FIG. 2, the nozzles N including the nozzles Na and the nozzles Nb are arrayed at a pitch (cycle) of θ. The pitch θ is the distance between the center of the nozzle Na and the center of the nozzle Nb in the Y-axis direction. In the following description, the signs of elements related to the nozzles Na of the first nozzle array La are given subscript a, and the signs of elements related to the nozzles Nb of the second nozzle array Lb are given subscript b. If there is no particular need to distinguish the nozzles Na of the first nozzle array La and the nozzles Nb of the second nozzle array Lb from each other, the nozzles Na and the nozzles Nb are each simply expressed as "nozzle N".

The liquid ejecting head 24 includes an individual channel array 25, as shown in FIG. 2. The individual channel array 25 is an aggregation of multiple individual channels Pa and multiple individual channels Pb. Each of the individual channels Pa extends in the X1-direction and corresponds to one of the different nozzles Na. The individual channels Pa communicate individually with the nozzles Na. Likewise, each of the individual channels Pb extends in the X1-direction and corresponds to one of the different nozzles Nb. The individual channels Pb communicate individually with the nozzles Nb. The details of the configuration of the individual channels Pa and the individual channels Pb will be described later. In the following description, if there is no particular need to distinguish the individual channels Pa and the individual channels Pb from each other, the individual channels Pa and the individual channels Pb are each simply referred to as "individual channel P".

The individual channels Pa and the individual channels Pb facing in the Y-axis direction has an inverted relationship about the Z-axis. Specifically, rotating the individual channels Pa 180° about the Z-axis brings the individual channels Pa to the same disposition as that of the individual channels Pb, and rotating the individual channels Pb 180° about the Z-axis brings the individual channels Pb to the same disposition as that of the individual channels Pa.

As shown in FIG. 2, the individual channels Pa each include a pressure chamber Ca1 and a pressure chamber Ca2. The pressure chamber Ca1 and the pressure chamber Ca2 in the individual channel Pa extend in the X1-direction.

The pressure chamber Ca1 and the pressure chamber Ca2 store the ink to be ejected from the nozzle Na communicating with the individual channel Pa. When the pressure in the pressure chamber Ca1 and the pressure chamber Ca2 changes, the ink is ejected from the nozzle Na. The pressure chamber Ca1 is an example of "first pressure chamber", and the pressure chamber Ca2 is an example of "second pressure chamber". Likewise, the individual channels Pb each include a pressure chamber Cb1 and a pressure chamber Cb2. The pressure chamber Cb1 and the pressure chamber Cb2 in the individual channel Pb extend in the X1-direction. The pressure chamber Cb1 and the pressure chamber Cb2 store the ink to be ejected from the nozzle Nb communicating with the individual channel Pb. When the pressure in the pressure chamber Cb1 and the pressure chamber Cb2 changes, the ink is ejected from the nozzle Nb. The pressure chamber Cb1 is an example of "third pressure chamber", and the pressure chamber Cb2 is an example of "fourth pressure chamber". In the following description, if there is no particular need to distinguish the pressure chambers Ca1 and Ca2 corresponding to the first nozzle array La and the pressure chambers Cb1 and Cb2 corresponding to the second nozzle array Lb, the pressure chambers Ca1, Ca2, Cb1, and Cb2 are each simply referred to as "pressure chamber C".

The liquid ejecting head 24 includes a first common liquid chamber R1 and a second common liquid chamber R2, as shown in FIG. 2. The first common liquid chamber R1 and the second common liquid chamber R2 extend in the Y-axis direction across the entire area in which the multiple nozzles N are distributed. The individual channel array 25 and the multiple nozzles N are located between the first common liquid chamber R1 and the second common liquid chamber R2 in plan view in the Z-axis direction. In the following description, the plan view in the Z-axis direction is simply referred to as "plan view".

The multiple individual channels P communicate, in common, with the first common liquid chamber R1. Specifically, an end E1 of each individual channel P in the X2-direction is coupled to the first common liquid chamber R1. Likewise, the multiple individual channels P communicate, in common, with the second common liquid chamber R2. Specifically, an end E2 of each individual channel P in the X1-direction is coupled to the second common liquid chamber R2. In the liquid ejecting head 24, the individual channels P communicate between the first common liquid chamber R1 and the second common liquid chamber R2. This allows the ink supplied from the first common liquid chamber R1 to the individual channels P to be ejected through the nozzles N. The ink that was not ejected is discharged into the second common liquid chamber R2.

The liquid ejecting head 24 includes a circulating mechanism 26, as shown in FIG. 2. The circulating mechanism 26 is a mechanism for circulating the ink discharged from the individual channels P into the second common liquid chamber R2 back to the first common liquid chamber R1. The circulating mechanism 26 includes a first supply pump 261, a second supply pump 262, a reserve container 263, a circulation channel 264, and a supply channel 265.

The first supply pump 261 is a pump that supplies the ink stored in the liquid container 12 to the reserve container 263. The reserve container 263 is a subtank that temporarily stores the ink supplied from the liquid container 12.

The circulation channel 264 is a channel that communicates between the second common liquid chamber R2 and the reserve container 263. The ink is discharged through a discharge channel Ra2 and a discharge channel Rb2 (described later) via the second common liquid chamber R2. The circulation channel 264 and the second common liquid chamber R2 are examples of "common discharge channel".

The reserve container 263 is supplied with the ink stored in the liquid container 12 by the first supply pump 261 and is also supplied with the ink discharged from the individual channels P into the second common liquid chamber R2, through the circulation channel 264.

The second supply pump 262 is a pump that pumps out the ink stored in the reserve container 263. The ink pumped out by the second supply pump 262 is supplied to the first common liquid chamber R1 through the supply channel 265. The supply channel 265 supplies the liquid to a supply channel Ra1 and a supply channel Rb1 (described later), in common. The supply channel 265 and the first common liquid chamber R1 are examples of "common supply channel".

The individual channels P of the individual channel array 25 include the individual channels Pa and the individual channels Pb. Each of the individual channels Pa is an individual channel P communicating with corresponding one of the nozzles Na in the first nozzle array La. Each of the individual channels Pb is an individual channel P communicating with corresponding one of the nozzles Nb in the second nozzle array Lb. The individual channels Pa and the individual channels Pb are alternately arrayed along the Y-axis. Thus, the individual channels Pa and the individual channels Pb face each other in the Y-axis direction.

The individual channels Pa each include a nozzle channel Nfa, as shown in FIG. 2. The nozzle channel Nfa extends in the X1-direction and is positioned between the pressure chamber Ca1 and the pressure chamber Ca2 as viewed in the Z2 direction, as shown in FIG. 2. The nozzle channel Nfa communicates between the pressure chamber Ca1 and the pressure chamber Ca2 and includes the nozzle Na that ejects the ink supplied from the pressure chamber Ca1. The nozzle channel Nfa is an example of "first nozzle channel".

The individual channels Pb each include a nozzle channel Nfb, as shown in FIG. 2. The nozzle channel Nfb extends in the X1-direction and is positioned between the pressure chamber Cb1 and the pressure chamber Cb2 as viewed in the Y-axis direction, as shown in FIG. 2. The nozzle channel Nfb communicates between the pressure chamber Cb1 and the pressure chamber Cb2 and includes the nozzle Nb that ejects the ink supplied from the pressure chamber Cb1. The nozzle channel Nfb is an example of "second nozzle channel".

The nozzle channels Nfa are arrayed in the Y-axis direction. The nozzle channels Nfb are arrayed in the Y-axis direction. The nozzle channel Nfa and the nozzle channel Nfb are disposed in parallel in the Y-axis direction, with a predetermined space therebetween. The nozzle channel Nfa and the nozzle channel Nfb adjacent in the Y-axis direction have an inverted relationship about the Z-axis. In the present application, "element A and element B are adjacent to each other" refers to "at least part of element A and at least part of element B face each other as viewed in a specific direction". Not the whole of element A and the whole of element B need to face each other. If at least part of element A and at least part of element B face, then it is determined that "element A and element B are adjacent to each other".

In the liquid ejecting head 24 of this embodiment, as shown in FIG. 2, the pressure chambers Ca1 for the different nozzles Na of the first nozzle array La and the pressure chambers Cb1 for the different nozzles Nb of the second nozzle array Lb are arrayed in parallel in the Y-axis direction. Likewise, the pressure chambers Ca2 for the different nozzles Na of the first nozzle array La and the pressure chambers Cb2 for the different nozzles Nb of the second nozzle array Lb are arrayed in parallel in the Y-axis direction. The array of the pressure chambers Ca1 and the pressure chambers Cb1 and the array of the pressure chambers Ca2 and the pressure chambers Cb2 are disposed in parallel in the X-axis direction, with a predetermined space therebetween. Although the positions of the pressure chambers Ca1 in the Y-axis direction and the positions of the pressure chambers Ca2 in the Y-axis direction are the same, the positions may differ. Although the positions of the pressure chambers Cb1 in the Y-axis direction and the positions of the pressure chambers Cb2 in the Y-axis direction are the same, the positions may differ.

Figure 3:
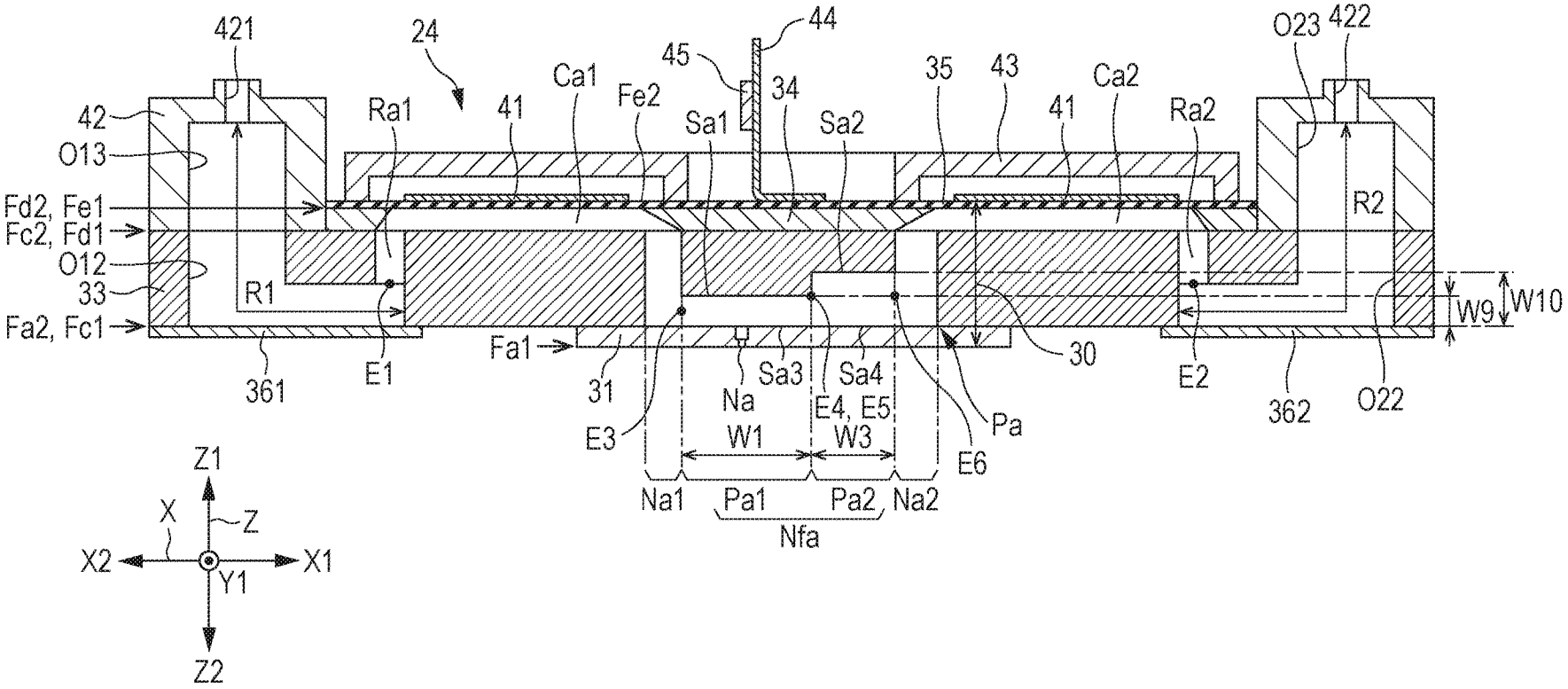
FIG. 3 is a cross-sectional view taken along line III-III in FIG. 2.
Figure 4:
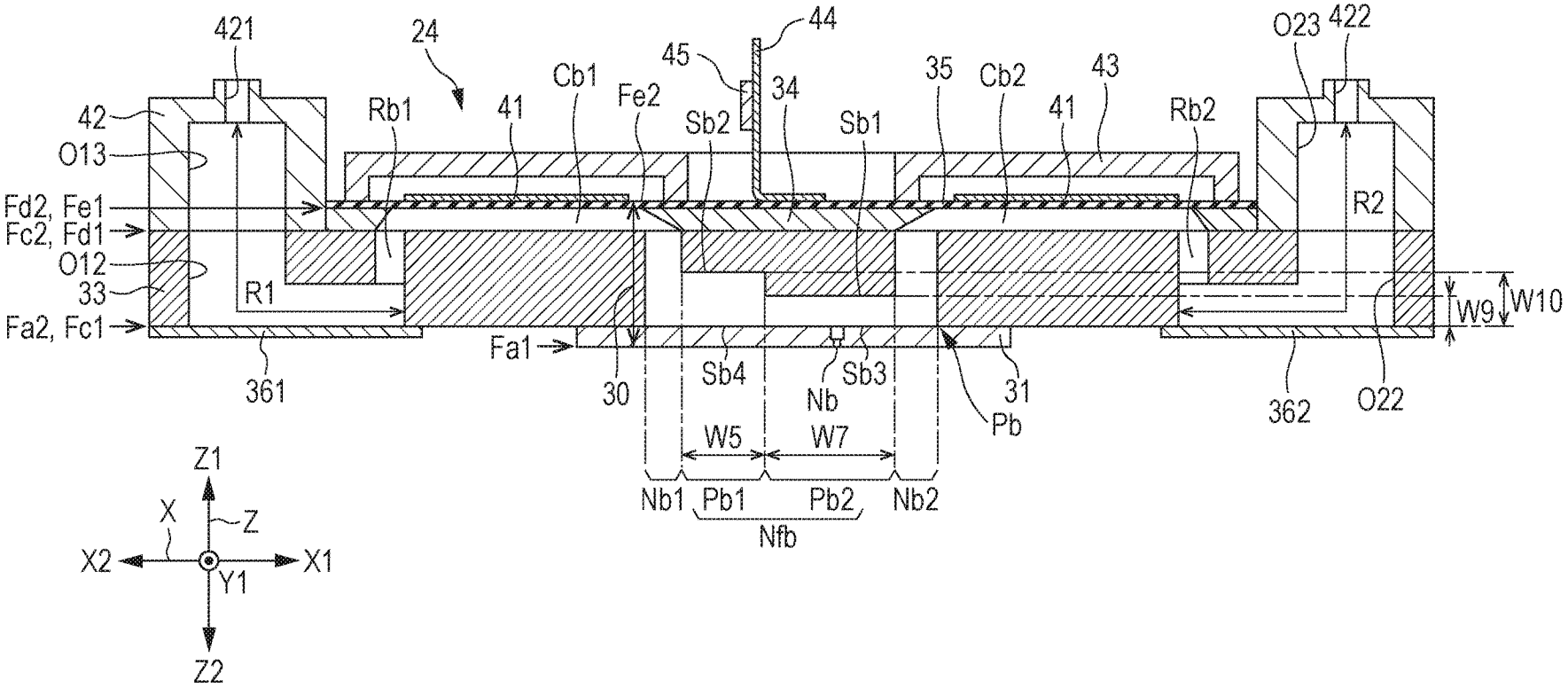
FIG. 4 is a cross-sectional view taken along line IV-IV in FIG. 2.

Next, the details of the configuration of the liquid ejecting head 24 will be described. FIG. 3 is a cross-sectional view taken along line III-III in FIG. 2. FIG. 4 is a cross-sectional view taken along line IV-IV in FIG. 2. FIG. 3 illustrates a cross section passing through the individual channel Pa. FIG. 4 illustrates a cross section passing through the individual channel Pb.

As shown in FIGS. 3 and 4, the liquid ejecting head 24 includes a channel structure 30, multiple piezoelectric elements 41, a casing 42, a protective substrate 43, and a wiring substrate 44. The channel structure 30 is a structure in which a channel including the first common liquid chamber R1, the second common liquid chamber R2, the individual channels P, and the nozzles N are formed.

The channel structure 30 is a structure in which a nozzle plate 31, a communication plate 33, a pressure chamber substrate 34, and a vibration plate 35 are layered in order in the Z1-direction. These elements constituting the channel structure 30 are produced by processing a silicon monocrystal substrate by, for example, a general processing method for producing a semiconductor.

The nozzle plate 31 has the multiple nozzles N formed therein. Each of the nozzles N is a cylindrical through-hole through which the ink is to be passed. As shown in FIGS. 3 and 4, the nozzle plate 31 is a plate-like member having a surface Fa1 facing in the Z2-direction and a surface Fa2 facing in the Z1-direction. The communication plate 33 is a plate-like member having a surface Fc1 facing in the Z2-direction and a surface Fc2 facing in the Z1-direction.

The elements constituting the channel structure 30 are each formed in a rectangular shape that is long in the Y-axis direction and are bonded to each other with, for example, an adhesive. For example, the surface Fa2 of the nozzle plate 31 is bonded to the surface Fc1 of the communication plate 33, and the surface Fc2 of the communication plate 33 is bonded to a surface Fd1 of the pressure chamber substrate 34. A surface Fd2 of the pressure chamber substrate 34 is bonded to a surface Fc1 of the vibration plate 35.

The communication plate 33 has a space O12 and a space O22. Each of the space O12 and the space O22 is an opening that is long in the Y-axis direction. On the surface Fc1 of the communication plate 33, a vibration absorber 361 that closes the space O12 and a vibration absorber 362 that closes the space O22 are disposed. The vibration absorber 361 and the vibration absorber 362 are layered members made of an elastic material.

The casing 42 is a case for storing ink. The casing 42 is joined to the surface Fc2 of the communication plate 33. The casing 42 has a space O13 communicating with the space O12 and a space O23 communicating with the space O22. Each of the space O13 and the space O23 is a space that is long in the Y-axis direction. The space O12 and the space O13 communicate with each other to form the first common liquid chamber R1. Likewise, the space O22 and the space O23 communicate with each other to form the second common liquid chamber R2. The vibration absorber 361 constitutes a wall surface of the first common liquid chamber R1 and absorbs a pressure change of the ink in the first common liquid chamber R1. The vibration absorber 362 constitutes a wall surface of the second common liquid chamber R2 and absorbs a pressure change of the ink in the second common liquid chamber R2.

The casing 42 has a supply port 421 and a discharge port 422. The supply port 421 is a conduit communicating with the first common liquid chamber R1 and is coupled to the supply channel 265 of the circulating mechanism 26. The ink pumped out by the second supply pump 262 into the supply channel 265 is supplied to the first common liquid chamber R1 through the supply port 421. The discharge port 422 is a conduit communicating with the second common liquid chamber R2 and is coupled to the circulation channel 264 of the circulating mechanism 26. The ink in the second common liquid chamber R2 is supplied to the circulation channel 264 through the discharge port 422.

The pressure chamber substrate 34 is provided with the pressure chambers Ca1 and Ca2 and the pressure chambers Cb1 and Cb2. The pressure chambers C are spaces between the surface Fc2 of the communication plate 33 and the vibration plate 35. The pressure chambers C are long along the X-axis and extends in the X1-direction in plan view.

The vibration plate 35 is an elastically vibratile plate-like member. The vibration plate 35 is a lamination of, for example, a first layer made of silicon oxide ($SiO_2$) and a second layer made of zirconium oxide ($ZrO_2$). The vibration plate 35 and the pressure chamber substrate 34 may be integrally formed by selectively removing, in the thickness direction, a part of the plate-like member with a predetermined thickness corresponding to the pressure chamber C. The vibration plate may be of a single layer.

On the surface Fe2 of the vibration plate 35, the piezoelectric elements 41 for the different pressure chambers C are disposed. The piezoelectric elements 41 for the individual pressure chambers C overlap with the pressure chambers C in plan view. Specifically, each piezoelectric element 41 is a lamination of a first electrode and a second electrode facing each other and a piezoelectric layer formed between the electrodes. The piezoelectric element 41 is an energy generating element that ejects the ink in the pressure chamber C through the nozzle N by generating energy to change the pressure of the ink in the pressure chamber C. The piezoelectric element 41 vibrates the vibration plate 35 by deforming the piezoelectric element 41 itself by receiving a driving signal. When the vibration plate 35 vibrates, the pressure chamber C expands and contracts. The expansion and contraction of the pressure chamber C cause pressure to be exerted to the ink from the pressure chamber C. This causes the ink to be ejected through the nozzle N.

The protective substrate 43 is a plate-like member disposed on the surface Fe2 of the vibration plate 35. The protective substrate 43 protects the piezoelectric elements 41 and also reinforces the mechanical strength of the vibration plate 35. The piezoelectric elements 41 are housed between the protective substrate 43 and the vibration plate 35. The wiring substrate 44 is disposed on the surface Fe2 of the vibration plate. The wiring substrate 44 is a surface-mounted component for electrically coupling the control unit 21 and the liquid ejecting head 24 together. Preferable examples of the wiring substrate 44 include a flexible printed circuit (FPC) and a flexible flat cable (FFC). On the wiring substrate 44, a driving circuit 45 for supplying a driving signal to each piezoelectric element 41 is mounted.

Figure 5:
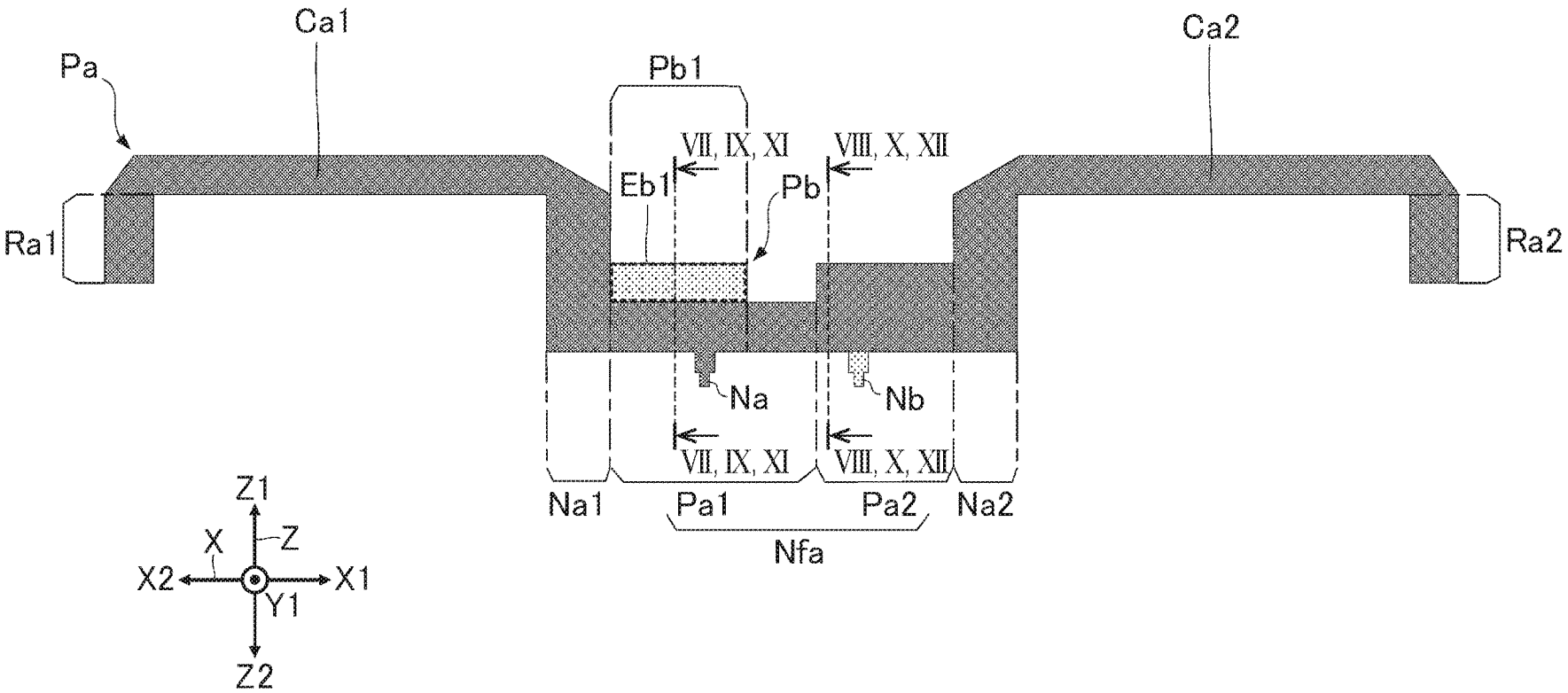
FIG. 5 is a side view of an individual channel illustrating a configuration example.
Figure 6:
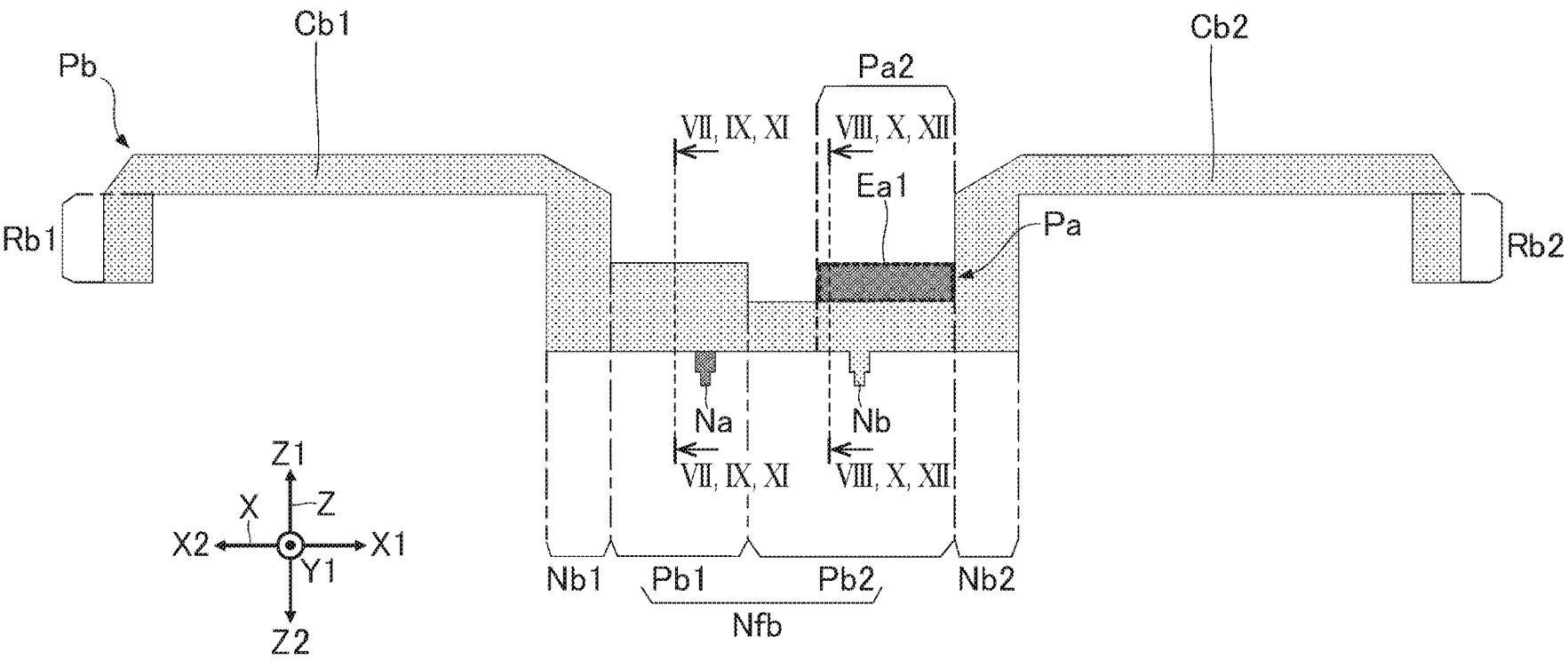
FIG. 6 is a side view of an individual channel illustrating a configuration example.

Next, the details of the configuration of the individual channels P will be described. FIG. 5 is a side view of the individual channel Pa illustrating a configuration example in which the individual channel Pa and the individual channel Pb face each other. As shown in FIG. 5 and FIG. 6 (described later), the shape of the individual channel Pa and the shape of the individual channel Pb have a rotationally symmetrical relationship about the axis of symmetry parallel to the Z-axis in plan view.

As shown in FIG. 5, the individual channel Pa includes the supply channel Ra1, the pressure chamber Ca1, a first communication channel Na1, the nozzle channel Nfa, a second communication channel Na2, the pressure chamber Ca2, and the discharge channel Ra2. The individual channel Pa is a channel in which these elements are integrated and coupled in the above order. As shown in FIG. 5, a first portion Pa1 of the nozzle channel Nfa and a third portion Pb1 of the nozzle channel Nfb overlap at least partially in the X1-direction. The whole of the third portion Pb1 overlap with the first portion Pa1 in the X1-direction, as shown in FIG. 5.

The supply channel Ra1 is a space formed in the communication plate 33. Specifically, as shown in FIG. 3, the supply channel Ra1 extends from the space O12 constituting the first common liquid chamber R1 to the surface Fc2 of the communication plate 33 along the Z-axis. An end of the supply channel Ra1 coupled to the space O12 is the end E1 of the individual channel Pa. The supply channel Ra1 is a channel communicating with the pressure chamber Ca1 to introduce the ink supplied from the first common liquid chamber R1 into the pressure chamber Ca1. The supply channel Ra1 is an example of "first individual supply channel".

As shown in FIG. 3, the first communication channel Na1 is a space passing through the communication plate 33. The first communication channel Na1 is a long channel extending along the Z-axis. The first communication channel Na1 extends in the Z1-direction to communicate between the pressure chamber Ca1 and the nozzle channel Nfa. The first communication channel Na1 is a channel that introduces the ink expelled from the pressure chamber Ca1 into the nozzle channel Nfa.

The nozzle channel Nfa is a channel provided in the communication plate 33 and extending in the X-axis direction. As shown in FIG. 3, the nozzle channel Nfa is segmented into the first portion Pa1 and a second portion Pa2. In this embodiment, the side at which the pressure chamber Ca1 and the pressure chamber Ca2 are positioned in the Z1-direction as viewed from the nozzle channel Nfa is referred to as "first side", and the side at which the nozzle Na is positioned in the Z2-direction is referred to as "second side". A channel wall surface Sa1 of the first portion Pa1 on the first side and a channel wall surface Sa2 of the second portion Pa2 on the first side are at different positions in the Z1-direction. A channel wall surface Sa3 of the first portion Pa1 on the second side and a channel wall surface Sa4 of the second portion Pa2 on the second side are at the same position in the Z2-direction. In other words, the first portion Pa1 has the channel wall surface Sa1 and the channel wall surface Sa3. The channel wall surface Sa3 is positioned between the ink ejecting plane of the nozzle Na and the channel wall surface Sa1 in the Z1-direction. Likewise, the second portion Pa2 has the channel wall surface Sa2 and the channel wall surface Sa4. The channel wall surface Sa4 is positioned between the ink ejecting plane of the nozzle Na and the channel wall surface Sa2 in the Z1-direction.

The first portion Pa1 is a channel positioned between the first communication channel Na1 and the second portion Pa2 in the X-axis direction and extending in the X-axis direction. The first portion Pa1 communicates between the first communication channel Na1 and the second portion Pa2 and includes the nozzle Na. The first portion Pa1 has an end E3 positioned in the X2-direction and an end E4 positioned in the X1-direction. An end of the nozzle channel Nfa coupled to the first communication channel Na1 is the end E3 of the first portion Pa1. In other words, the first portion Pa1 includes an end of the nozzle channel Nfa positioned in the X2-direction. The first portion Pa1 is a channel that guides the ink supplied through the first communication channel Na1 but not ejected from the nozzle Na to the second portion Pa2. The width W1 of the first portion Pa1 in the X1-direction is larger than the width W3 of the second portion Pa2 in the X1-direction, as shown in FIG. 3.

The second portion Pa2 is a channel positioned between the first portion Pa1 and the second communication channel Na2 in the X-axis direction and extending by a predetermined amount in the X-axis direction and the Z-axis direction. The second portion Pa2 communicates between the first portion Pa1 and the second communication channel Na2 and has an end E5 positioned in the X2-direction and an end E6 positioned in the X1-direction. An end of the nozzle channel Nfa coupled to the second communication channel Na2 is the end E6 of the second portion Pa2, and an end E4 of the first portion Pa1 coupled to the second portion Pa2 is the end E5 of the second portion Pa2. In other words, the second portion Pa2 includes an end of the nozzle channel Nfa positioned in the X1-direction. The second portion Pa2 is a channel that introduces the ink supplied from the first portion Pa1 into the second communication channel Na2.

As shown in FIG. 3, the width W3 of the second portion Pa2 in the X1-direction is smaller than the width W1 of the first portion Pa1 in the X1-direction. The width W10 of the second portion Pa2 in the Z1-direction is larger than the width W9 of the first portion Pa1 in the Z1-direction, as shown in FIG. 3. This allows reducing structural crosstalk. The details will be described later. The "structural crosstalk" is a phenomenon in which a vibration caused by a change in the inner pressure of one individual channel propagates to the other individual channel to decrease the ejection characteristics of the nozzle communicating with the individual channel. The definition of the structural crosstalk applies also to the following description.

The second communication channel Na2 is a space passing through the communication plate 33. The second communication channel Na2 is a long channel extending along the Z-axis. The second communication channel Na2 extends in the Z1-direction to communicate between the pressure chamber Ca2 and the nozzle channel Nfa. The second communication channel Na2 is a channel that introduces the ink supplied from the second portion Pa2 into the pressure chamber Ca2.

The discharge channel Ra2 is a space formed in the communication plate 33. Specifically, the discharge channel Ra2 extends from the space O22 constituting the second common liquid chamber R2 to the surface Fc2 of the communication plate 33 along the Z-axis. An end of the discharge channel Ra2 coupled to the space O22 is the end E2 of the individual channels Pa. The discharge channel Ra2 is a channel communicating with the pressure chamber Ca2 to introduce the ink expelled from the pressure chamber Ca2 into the second common liquid chamber R2. The discharge channel Ra2 is an example of "first individual discharge channel".

With the above configuration, the liquid ejecting head 24 ejects ink while circulating the ink during the operation of the liquid ejecting apparatus 100. Specifically, the ink from the liquid container 12 is supplied to the first common liquid chamber R1 through the supply channel 265. Then, a driving unit including the driving circuit 45 outputs a driving signal for driving the piezoelectric element 41 to the piezoelectric element 41 for the pressure chamber Ca1 and the piezoelectric element 41 for the pressure chamber Ca2 to drive the piezoelectric element 41 for the pressure chamber Ca1 and the piezoelectric element 41 for the pressure chamber Ca2 at the same time. This causes the ink supplied to the first common liquid chamber R1 to be ejected from the nozzle Na. Of the ink supplied to the first portion Pa1, the ink not ejected from the nozzle Na is supplied to the second common liquid chamber R2 through the discharge channel Ra2. As will be understood from the above description, the first portion Pa1 is a channel upstream of the nozzle channel Nfa, and the second portion Pa2 is a channel downstream of the nozzle channel Nfa. The piezoelectric element 41 for the pressure chamber Ca1 is an example of "first energy generating element", and the piezoelectric element 41 for the pressure chamber Ca2 is an example of "second energy generating element".

FIG. 6 is a side view of the individual channel Pb illustrating a configuration example in which the individual channel Pa and the individual channel Pb face each other. The individual channel Pb has a configuration in which the individual channel Pa is inverted 180°. As shown in FIG. 4, the width W9 of the fourth portion Pb2 in the Z1-direction is smaller than the width W10 of the third portion Pb1 in the Z1-direction. The width W7 of the fourth portion Pb2 in the X1-direction is larger than the width W5 of the third portion Pb1 in the X1-direction. The width W9 of the fourth portion Pb2 in the Z1-direction is equal to the width W9 of the first portion Pa1 in the Z1-direction. The width W10 of the third portion Pb1 in the Z1-direction is equal to the width W10 of the second portion Pa2 in the Z1-direction. The width W5 of the third portion Pb1 in the X1-direction is equal to the width W3 of the second portion Pa2 in the X1-direction. The width W7 of the fourth portion Pb2 in the X1-direction is equal to the width W1 of the first portion Pa1 in the X1-direction. Specifically, as shown in FIG. 6, the individual channel Pb includes the supply channel Rb1, the pressure chamber Cb1, a third communication channel Nb1, a nozzle channel Nfb, a fourth communication channel Nb2, the pressure chamber Cb2, and the discharge channel Rb2. The nozzle channel Nfb has the third portion Pb1 and the fourth portion Pb2. The individual channel Pb is a channel in which these elements are integrated and coupled in the above order. As shown in FIG. 6, the second portion Pa2 and the fourth portion Pb2 overlap at least partially in the X1-direction. The whole of the second portion Pa2 overlap with the fourth portion Pb2 in the X1-direction, as shown in FIG. 6.

The description of the structure of the individual channels Pa can be used as the description of the components of the individual channels Pb by replacing the subscript a of the signs of the elements of the individual channels Pa with subscript b. The supply channel Rb1 is an example of "second individual supply channel". The discharge channel Rb2 is an example of "second individual discharge channel".

With the above configuration, the liquid ejecting head 24 supplies the ink form the liquid container 12 to the first common liquid chamber R1 through the supply channel 265. Then, the driving unit including the driving circuit 45 outputs a driving signal for driving the piezoelectric element 41 to the piezoelectric element 41 for the pressure chamber Cb1 and the piezoelectric element 41 for the pressure chamber Cb2 to drive the piezoelectric element 41 for the pressure chamber Cb1 and the piezoelectric element 41 for the pressure chamber Cb2 at the same time. This causes the ink supplied to the first common liquid chamber R1 to be ejected from the nozzle Nb. Of the ink supplied to the third portion Pb1, the ink not ejected from the nozzle Nb is supplied to the second common liquid chamber R2 through the discharge channel Rb2. As will be understood from the above description, the third portion Pb1 is a channel upstream of the nozzle channel Nfb, and the fourth portion Pb2 is a channel downstream of the nozzle channel Nfb.

The liquid ejecting head 24 of this embodiment prevents the ink ejection characteristics from becoming worse by circulating the ink during ejection to prevent the ink in the vicinity of the nozzles Na and Nb from becoming thick and the component from being precipitated. This allows the ink ejection characteristics to be made approximately even to prevent variations in ejection characteristics, improving the ink ejection quality. Examples of the "ejection characteristics" include an ink ejection rate and an ink ejection speed.

Figure 7:
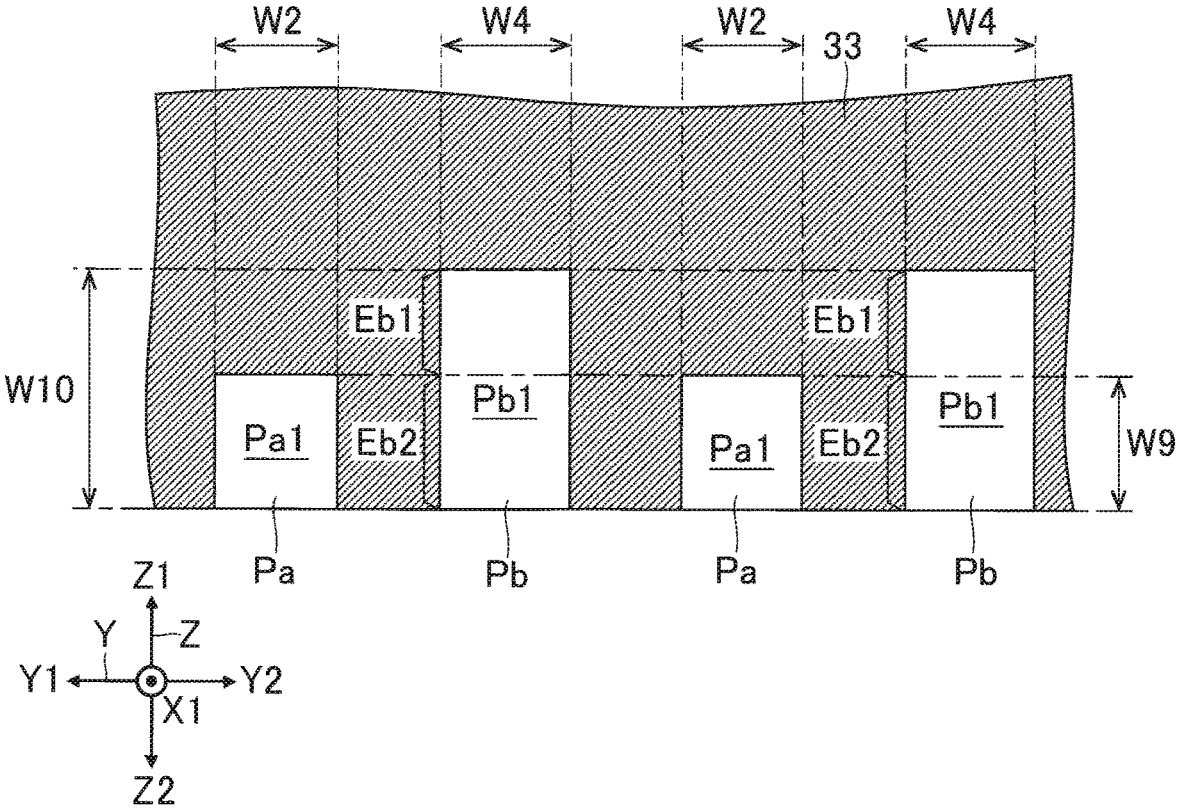
FIG. 7 is a cross-sectional view taken along line VII-VII in FIGS. 5 and 6.
Figure 8:
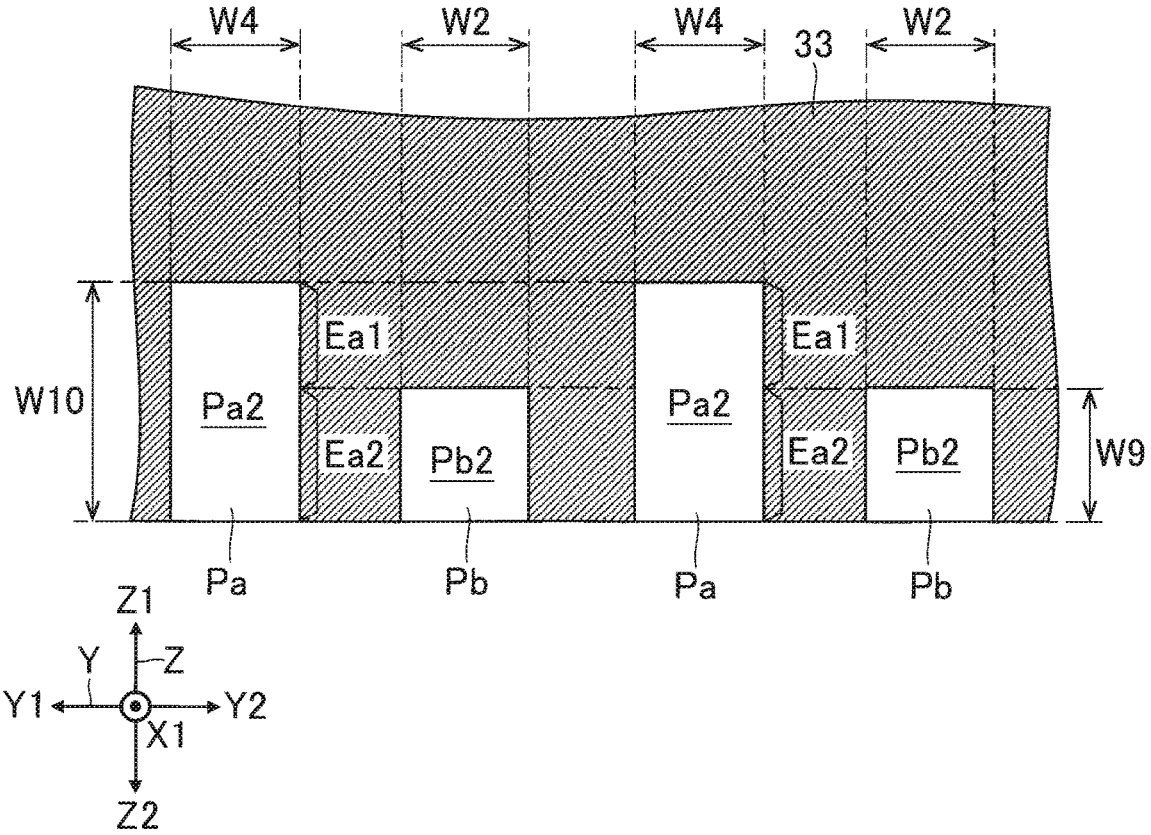
FIG. 8 is a cross-sectional view taken along line VIII-VIII in FIGS. 5 and 6.

FIG. 7 is a cross-sectional view taken along line VII-VII in FIGS. 5 and 6. FIG. 8 is a cross-sectional view taken along line VIII-VIII in FIGS. 5 and 6. As shown in FIGS. 5 to 7, the first portion Pa1 and the third portion Pb1 are alternately arranged along the Y-axis direction in the cross-sectional view taken along line VII-VII. As shown in FIGS. 5, 6 and 8, the second portion Pa2 and the fourth portion Pb2 are alternately arranged in the Y-axis direction in the cross-sectional view taken along line VIII-VIII.

As shown in FIGS. 7 and 8, the first portion Pa1 and the fourth portion Pb2 have a width of W2 in the Y-axis direction and a width of W9 in the Z-axis direction. The second portion Pa2 and the third portion Pb1 have a width of W4 in the Y-axis direction and a width of W10 in the Z-axis direction. The width W4 is equal to the width W2, and the width W10 is larger than the width W9.

The cross-sectional area of the nozzle channel Nfa viewed from the X-axis direction is as small as W2×W9 in the first portion Pa1 but is as large as W4×W10 in the second portion Pa2, so that the channel resistance of the entire nozzle channel Nfa is relatively small. Likewise, the channel cross-sectional area of the nozzle channel Nfb viewed from the X-axis direction is as small as W2×W9 in the fourth portion Pb2 but is as large as W4×W10 in the third portion Pb1, so that the channel resistance of the entire nozzle channel Nfb is relatively small.

In the VII-VII cross-section of FIG. 7, the first portion Pa1 with a width of W9 in the Z-axis direction and the third portion Pb1 with a width of W10 in the Z-axis direction, which is larger than W9, are disposed so as to be adjacent to each other in the Y-axis direction. Accordingly, in a range Eb1, the third portion Pb1 is present, but the first portion Pa1 is not present, as shown in FIG. 7. In other words, the channel is present at adjacent positions in the Y-axis direction in a range Eb2 but is not present at adjacent positions in the Y-axis direction in the range Eb1 which is the difference between W10 and W9 in the Z-axis direction. For that reason, even if a vibration due to ink flow is generated in the third portion Pb1 in the range Eb1, the vibration is less likely to be transmitted to the first portion Pa1 because the first portion Pa1 is not present at the overlapping position in the Z-axis direction, reducing the influence on the ejection from the nozzle Na. In other words, structural crosstalk is unlikely to occur. Also for the VIII-VIII cross section of FIG. 8, since the fourth portion Pb2 is not present at the position overlapping with the second portion Pa2 in range Ea1 in the Z-axis direction, a vibration from the second portion Pa2 in range Ea1 is less likely to be transmitted to the fourth portion Pb2, reducing the possibility of structural crosstalk.

Thus, this embodiment allows for reducing structural crosstalk while preventing an increase in the channel resistance of the nozzle channel Nfa and the nozzle channel Nfb.

Comparative Example 1

Figure 9:
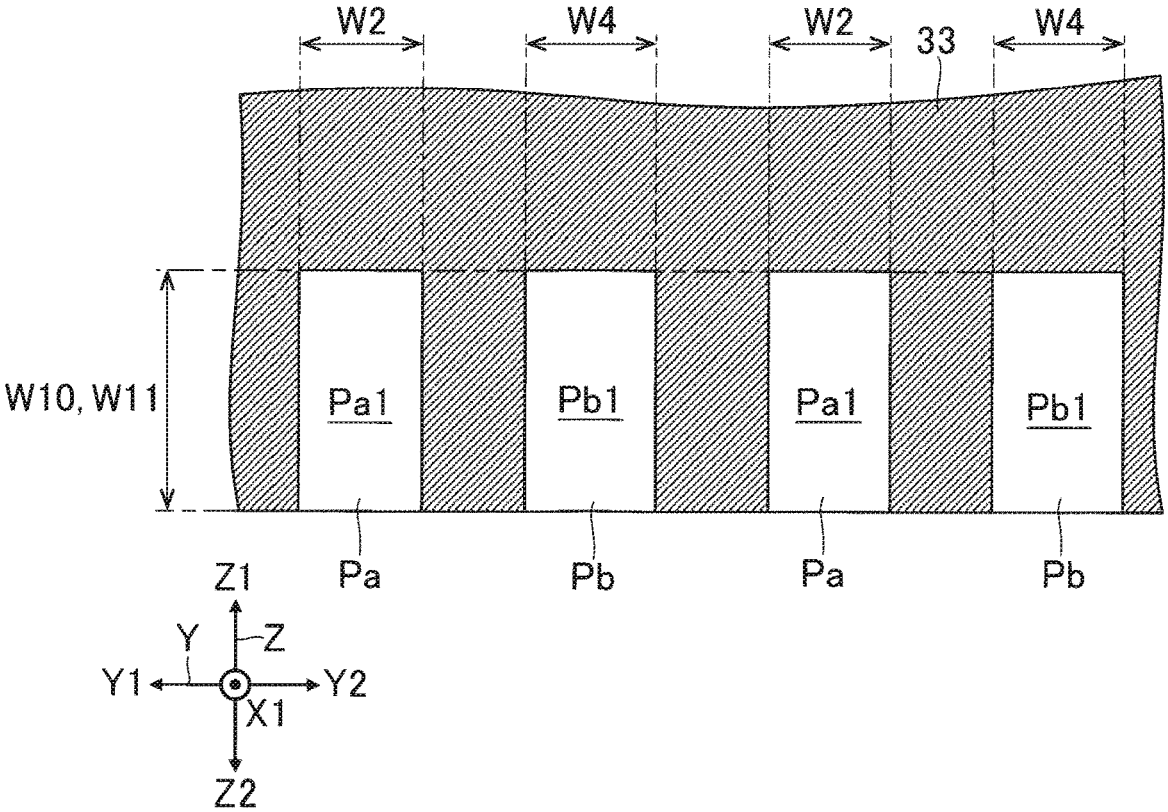
FIG. 9 is a cross-sectional view taken along line IX-IX in FIGS. 5 and 6 according to a comparative example of the present disclosure.
Figure 10:
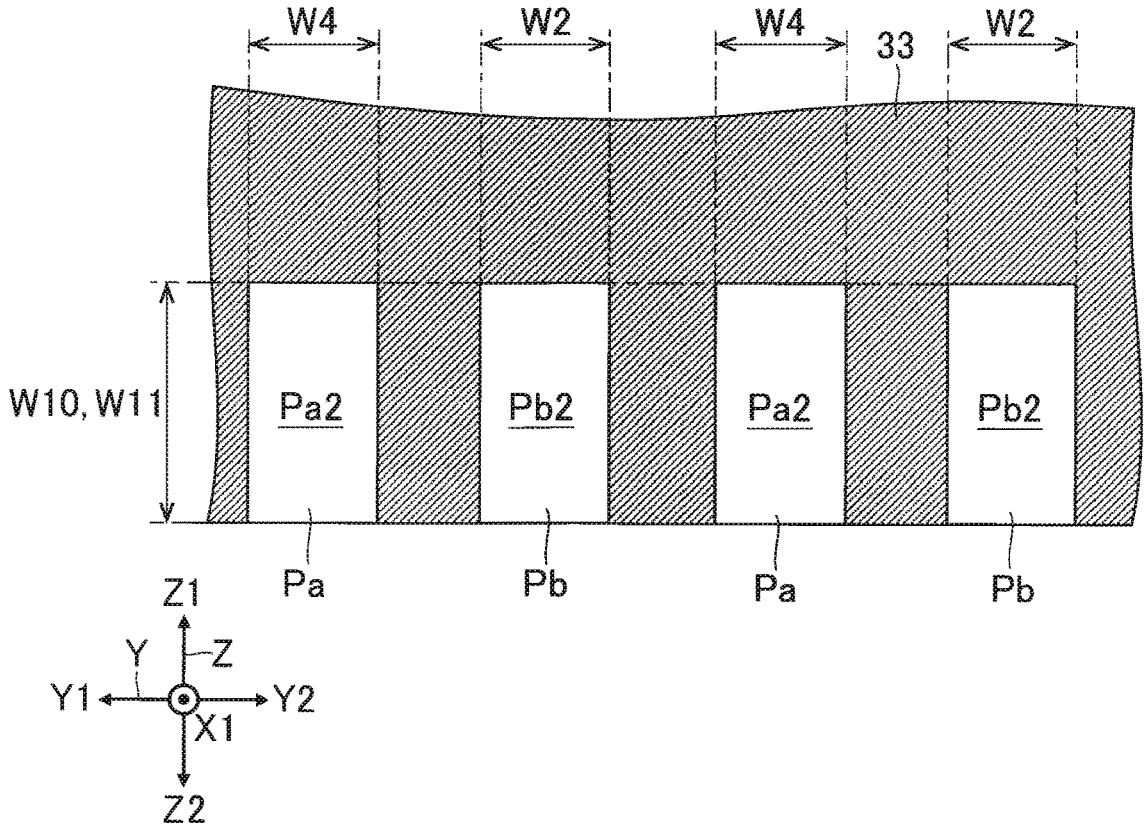
FIG. 10 is a cross-sectional view taken along line X-X in FIGS. 5 and 6 according to the comparative example.

FIG. 9 is a cross-sectional view taken along line IX-IX in FIGS. 5 and 6 according to a comparative example of the present disclosure. FIG. 10 is a cross-sectional view taken along line X-X in FIGS. 5 and 6 according to the comparative example. In comparative example 1, the first portion Pa1 and the fourth portion Pb2 have a width of W11 in the Z-axis direction. Other than that, the comparative example 1 is similar to the first embodiment. The width W11 is equal to the width W10, as shown in FIGS. 9 and 10, and is larger than the width W9, shown in FIGS. 7 and 8.

In comparative example 1, the first portion Pa1 and the third portion Pb1 with a width of W11 in the Z-axis direction are adjacent to each other in the Y-axis direction, as shown in the IX-IX cross section of FIG. 9. In other words, the range Eb1 in which no channel is present in adjacent positions in the Y-axis direction is not present, unlike the first embodiment. In the first embodiment, the width of the range Eb2 in the Z-axis direction in which the channel is present at adjacent positions in the Y-axis direction is the width W9, while, in the comparative example 1, the width is as large as W10. Accordingly, when vibration occurs in the third portion Pb1, it exerts large influence on the ejection from the nozzle Na in the first portion Pa1. In other words, structural crosstalk is likely to occur. The principle in which the structural crosstalk is likely to occur applies also to the X-X cross section of FIG. 10.

Thus, the configuration of the liquid ejecting head 24 according to comparative example 1 can cause significant structural crosstalk.

Comparative Example 2

Figure 11:
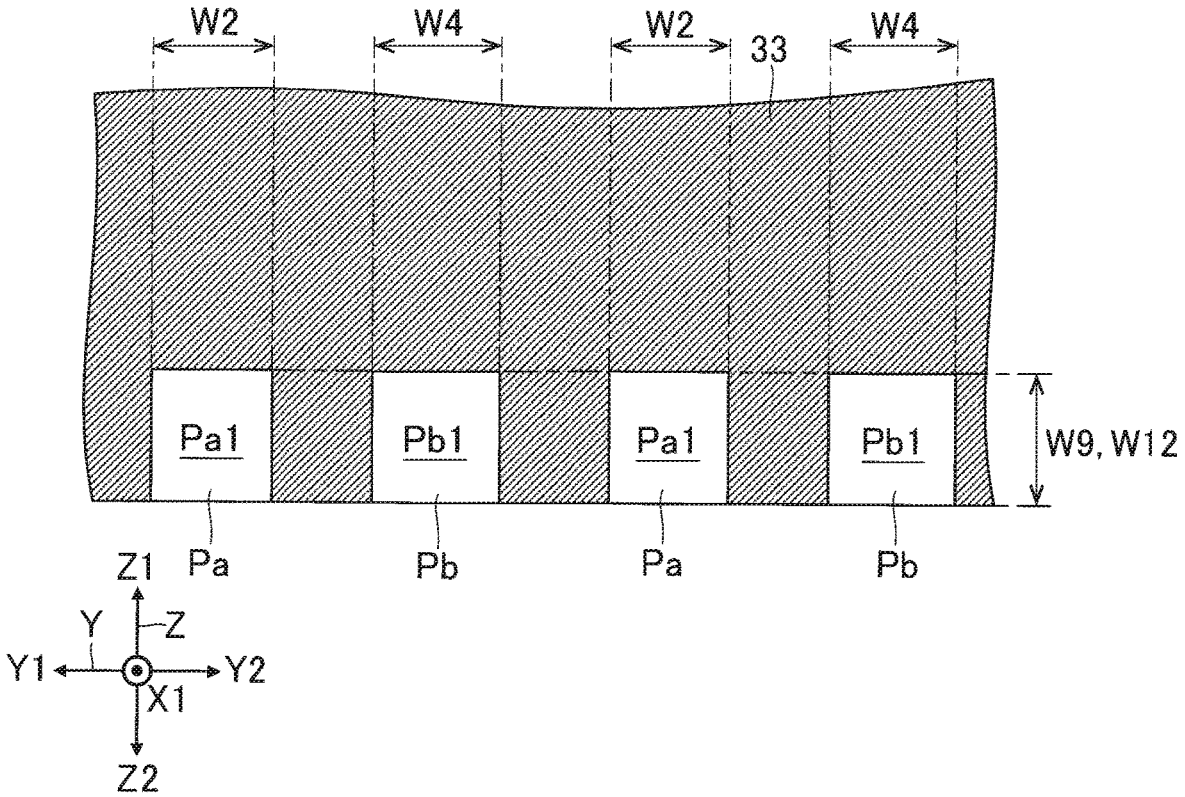
FIG. 11 is a cross-sectional view taken along line XI-XI in FIGS. 5 and 6 according to another comparative example of the present disclosure.
Figure 12:
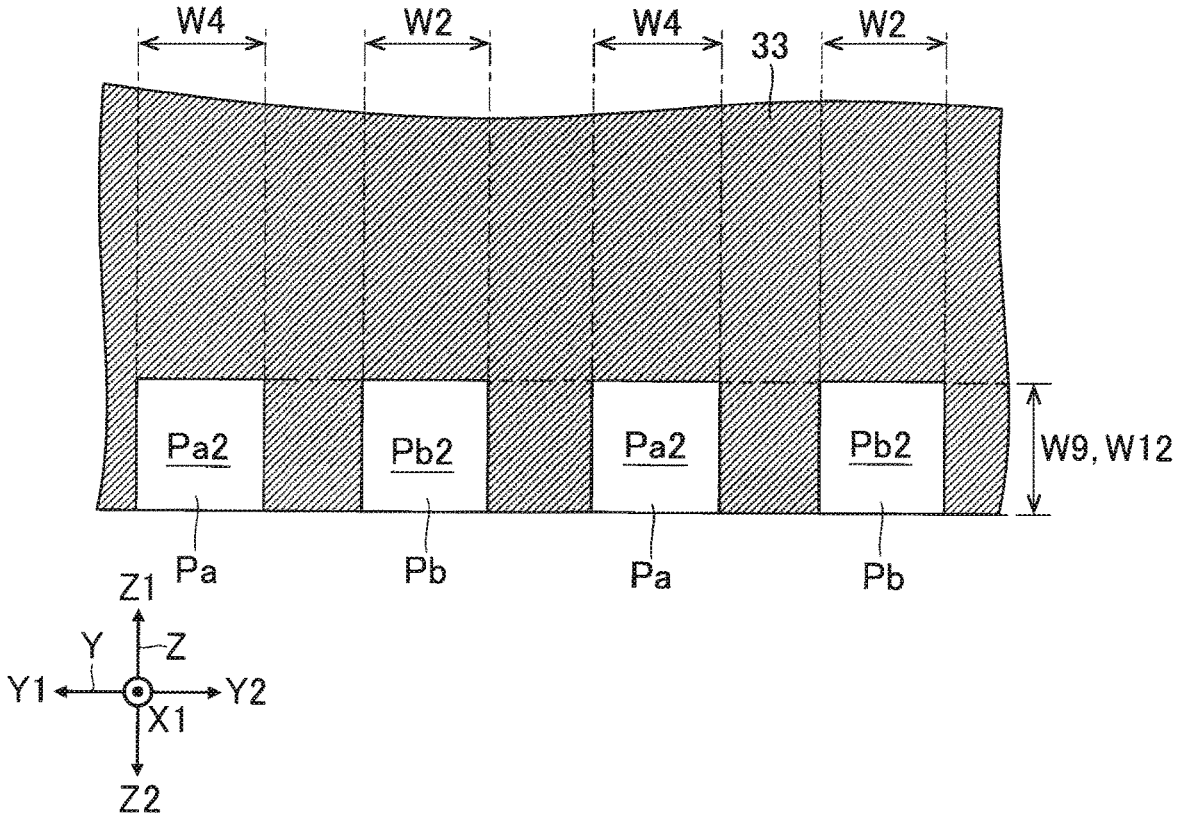
FIG. 12 is a cross-sectional view taken along line XII-XII in FIGS. 5 and 6 according to the comparative example.

FIG. 11 is a cross-sectional view taken along line XI-XI in FIGS. 5 and 6 according to another comparative example of the present disclosure. FIG. 12 is a cross-sectional view taken along line XII-XII in FIGS. 5 and 6 according to the comparative example. In comparative example 2, the second portion Pa2 and the third portion Pb1 have a width of W12 in the Z-axis direction. Other than that, the comparative example 2 has a similar configuration to the configuration of the first embodiment. The width W12 is equal to the width W9, as shown in FIG. 11, and is smaller than the width W10, shown in FIGS. 7 and 8.

In comparative example 2, as shown in FIGS. 11 and 12, the channel cross-sectional area of the nozzle channel Nfa viewed from the X-axis direction is W2×W9 in the first portion Pa1 and W4×W12 in the second portion Pa2. Thus, the channel cross-sectional areas in the first portion Pa1 and the second portion Pa2 are small, increasing the channel resistance of the entire nozzle channel Nfa. The channel resistance increases because of the above principle applies also to the nozzle channel Nfb.

Thus, the channel resistance increases in comparative example 2.

Second Embodiment

Figure 13:
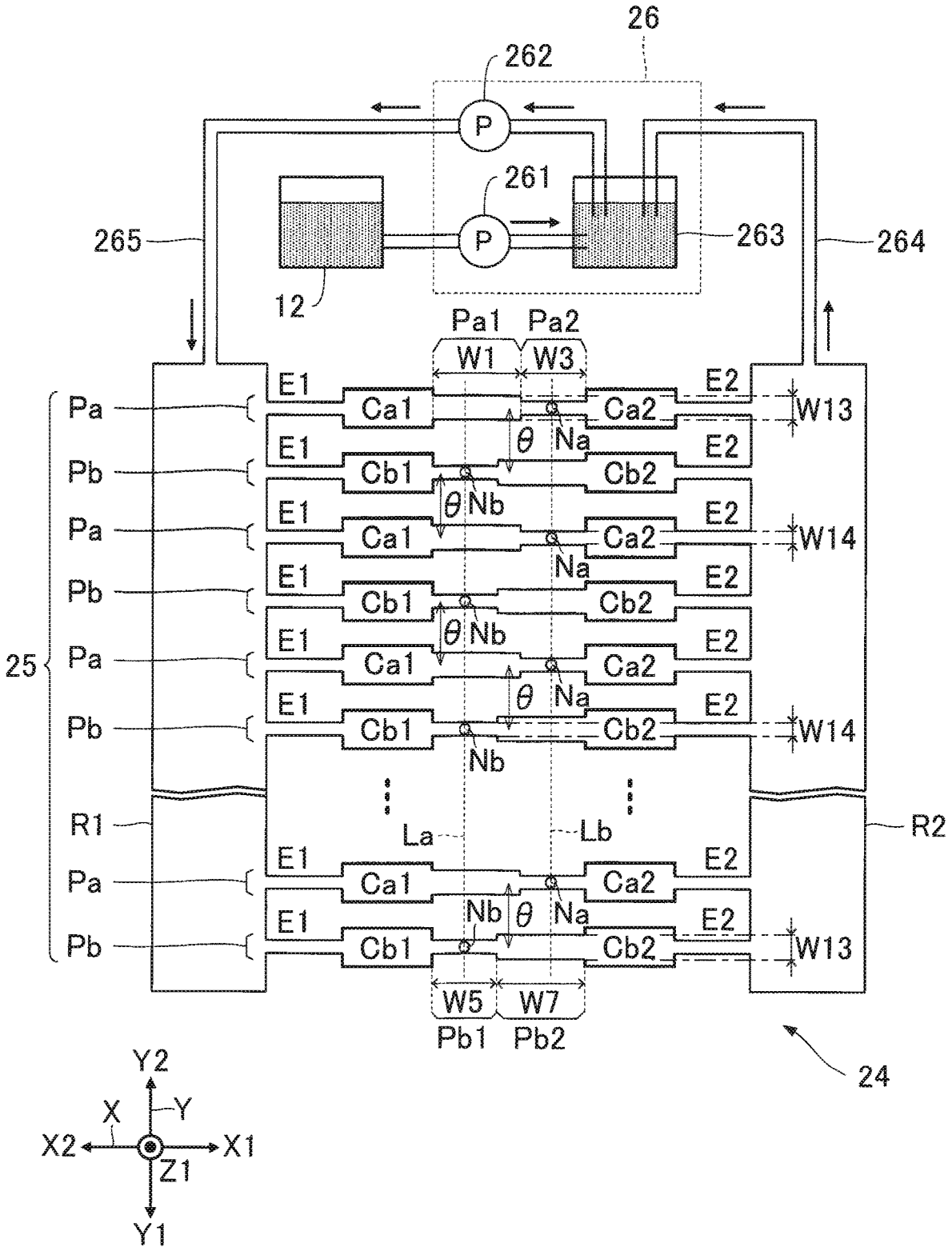
FIG. 13 is a schematic diagram illustrating a channel structure in a liquid ejecting head according to a second embodiment.

FIG. 13 is a schematic diagram illustrating a channel structure in a liquid ejecting head 24 according to a second embodiment as viewed in the Z-axis direction. Components similar to those of the first embodiment are given the same reference signs, and detailed descriptions thereof will be omitted or simplified.

The second embodiment has the same configuration as that of the first embodiment except that the widths of the first portion Pa1 and the fourth portion Pb2 in the Y-axis direction are W13, and the widths of the second portion Pa2 and the third portion Pb1 in the Y-axis direction are W14. The width W13 is larger than the width W2 in FIG. 2, and the width W14 is smaller than the width W4 in FIG. 2.

In the first embodiment, an increase in the channel resistance of the entire nozzle channel Nfa can be prevented by increasing the channel cross-sectional area of the second portion Pa2 to some extent, but the nozzle channel Nfa locally has high channel resistance. In other words, the channel cross-sectional area of the first portion Pa1 is as small as W2×W9, as shown in FIG. 7, which increases the local channel resistance in the first portion Pa1 to some extent, causing the rate to be limited, possibly exerting an influence on the channel resistance of the entire nozzle channel Nfa.

For that reason, in the second embodiment, the width W13 of the first portion Pa1 and the fourth portion Pb2 in the Y-axis direction is increased from that of the first embodiment. This can decrease the channel resistance of the first portion Pa1 and the fourth portion Pb2.

However, merely increasing the widths of the first portion Pa1 and the fourth portion Pb2 in the Y-axis direction decreases the communication plate 33 between the first portion Pa1 and the third portion Pb1. This is likely to cause structural crosstalk. For that reason, in the second embodiment, the width W14 of the second portion Pa2 and the third portion Pb1 in the Y-axis direction is decreased from the first embodiment so that the thickness of the communication plate 33 between the first portion Pa1 and the third portion Pb1 is the same as that of the first embodiment, preventing the occurrence of structural crosstalk. Furthermore, the second portion Pa2 and the third portion Pb1 have a large width of W10 in the Z-axis direction. This configuration does not increase the local channel resistance so much even if the width in the Y-axis direction is as small as W14. Thus, the second embodiment can prevent an increase in local channel resistance as compared with the first embodiment.

Third Embodiment

Figure 14:
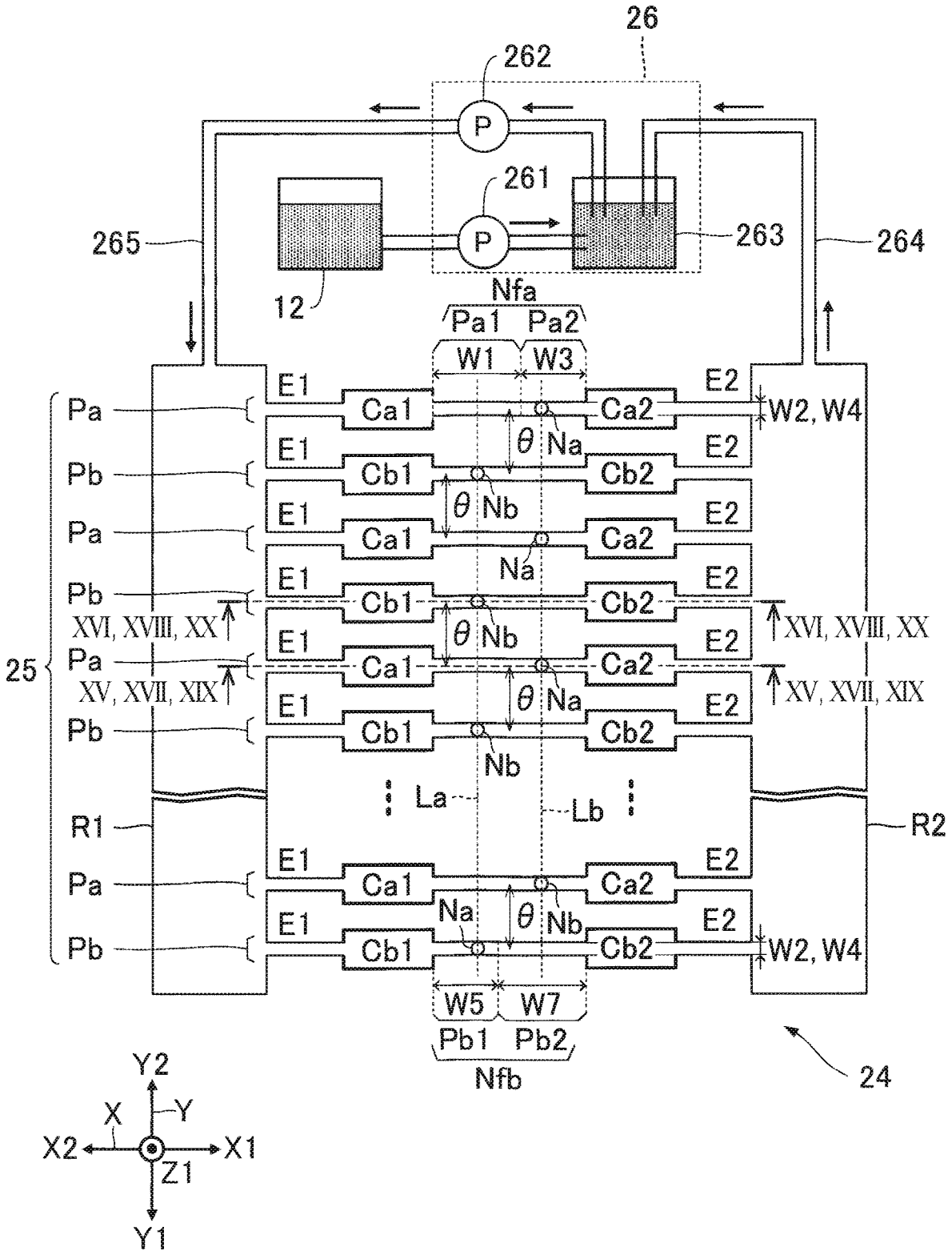
FIG. 14 is a schematic diagram illustrating a channel structure in a liquid ejecting head according to a third embodiment.
Figure 15:
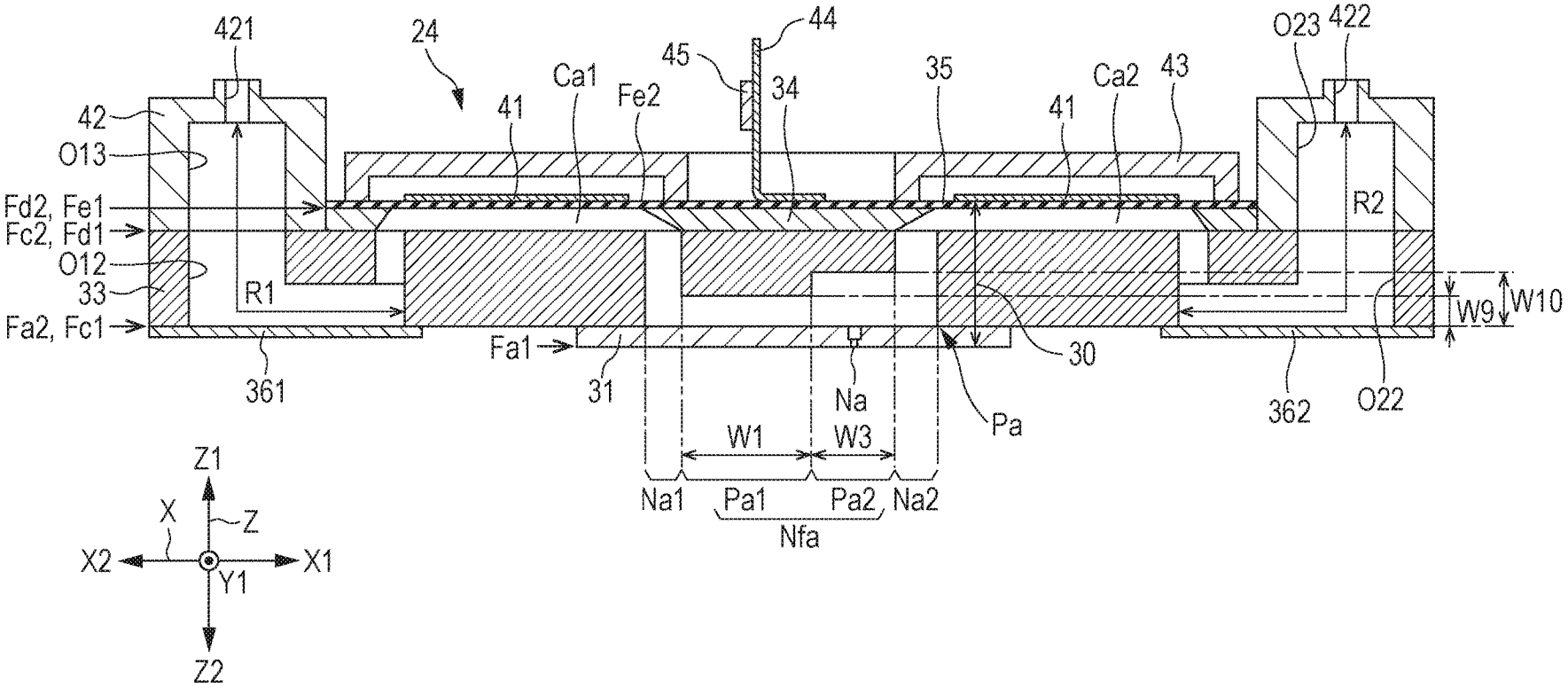
FIG. 15 is a cross-sectional view taken along line XV-XV in FIG. 14 according to the third embodiment.
Figure 16:
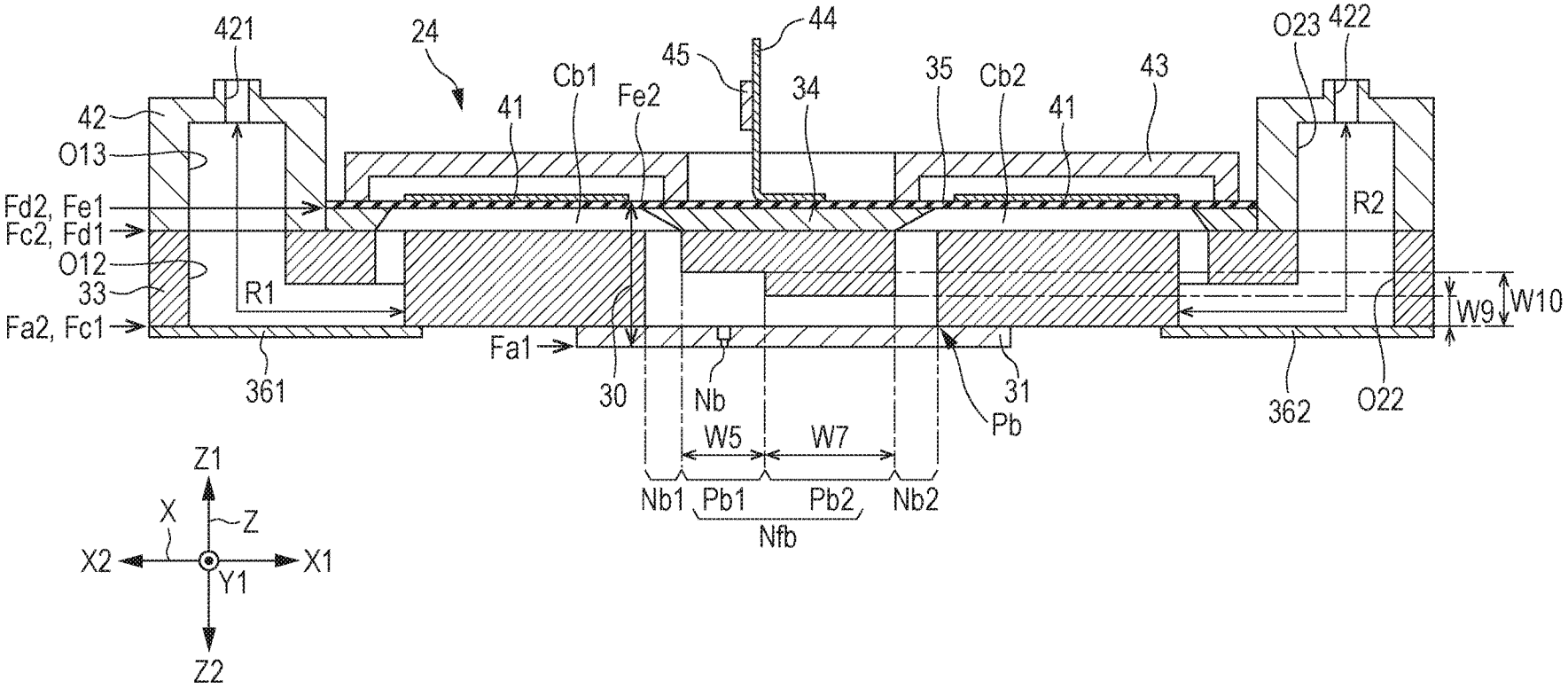
FIG. 16 is a cross-sectional view taken along line XVI-XVI in FIG. 14 according to the third embodiment.

FIG. 14 is a schematic diagram illustrating a channel structure in a liquid ejecting head 24 according to a third embodiment as viewed in the Z-axis direction. FIG. 15 is a cross-sectional view taken along line XV-XV in FIG. 14. FIG. 16 is a cross-sectional view taken along line XVI-XVI in FIG. 14. Components similar to those of the first and second embodiments are given the same reference signs, and detailed descriptions thereof will be omitted or simplified.

The liquid ejecting head 24 of the third embodiment differs from the first embodiment in that the nozzle Na is disposed in the second portion Pa2 of the individual channel Pa, and the nozzle Nb is disposed in the third portion Pb1 of the individual channel Pb.

In the third embodiment, the individual channels Pa and the individual channels Pb are 180° inverted about the Z-axis, and the nozzle channel Nfa and the nozzle channel Nfb overlap in side view in the Y-axis direction. Thus, the second portion Pa2 of the individual channel Pa has a portion completely overlapping with the fourth portion Pb2 and a portion not overlapping therewith in side view, as in the first embodiment. The third portion Pb1 of the individual channel Pb also has a portion completely overlapping with the first portion Pa1 and a portion not overlapping in side view. The liquid ejecting head 24 of the third embodiment therefore provides the same operational advantage as in the first embodiment.

Fourth Embodiment

Figure 17:
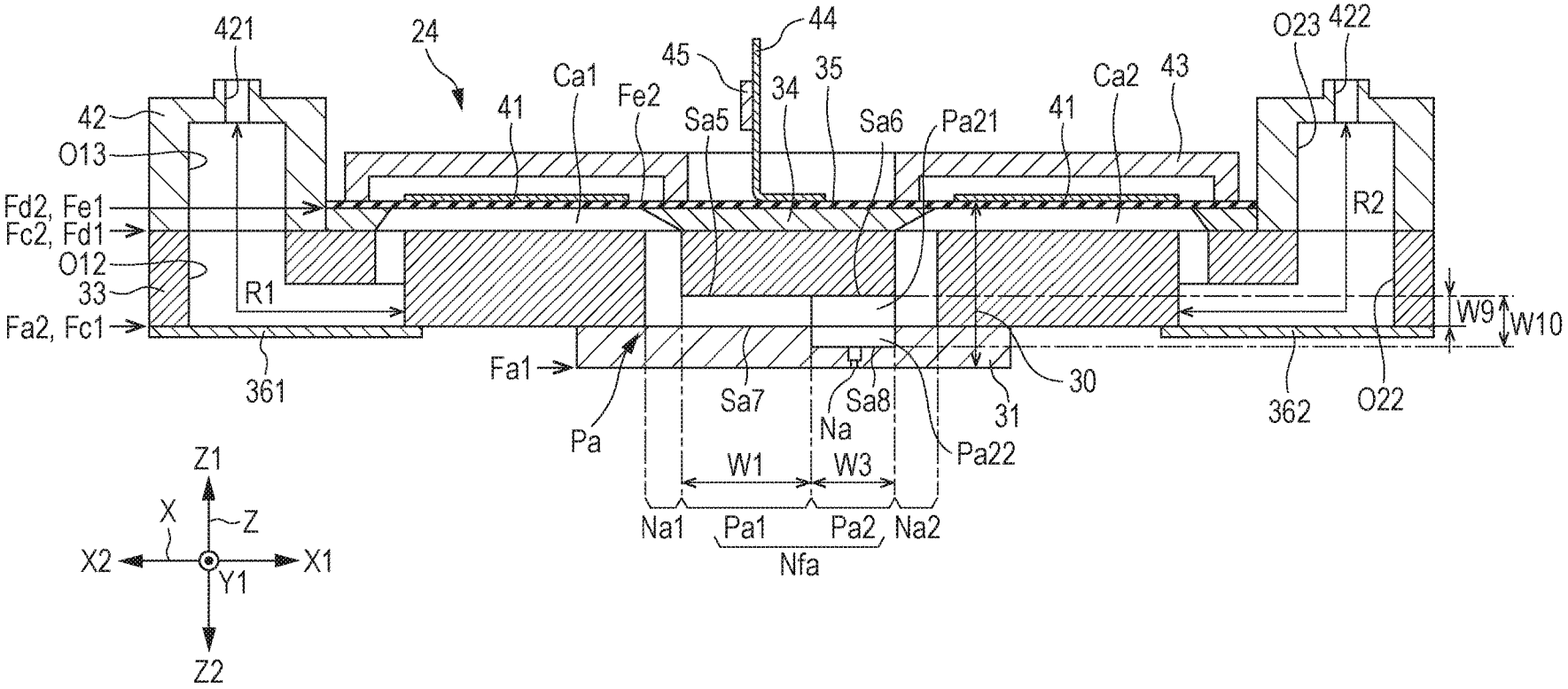
FIG. 17 is a cross-sectional view taken along line XVII-XVII in FIG. 14 according to a fourth embodiment.
Figure 18:
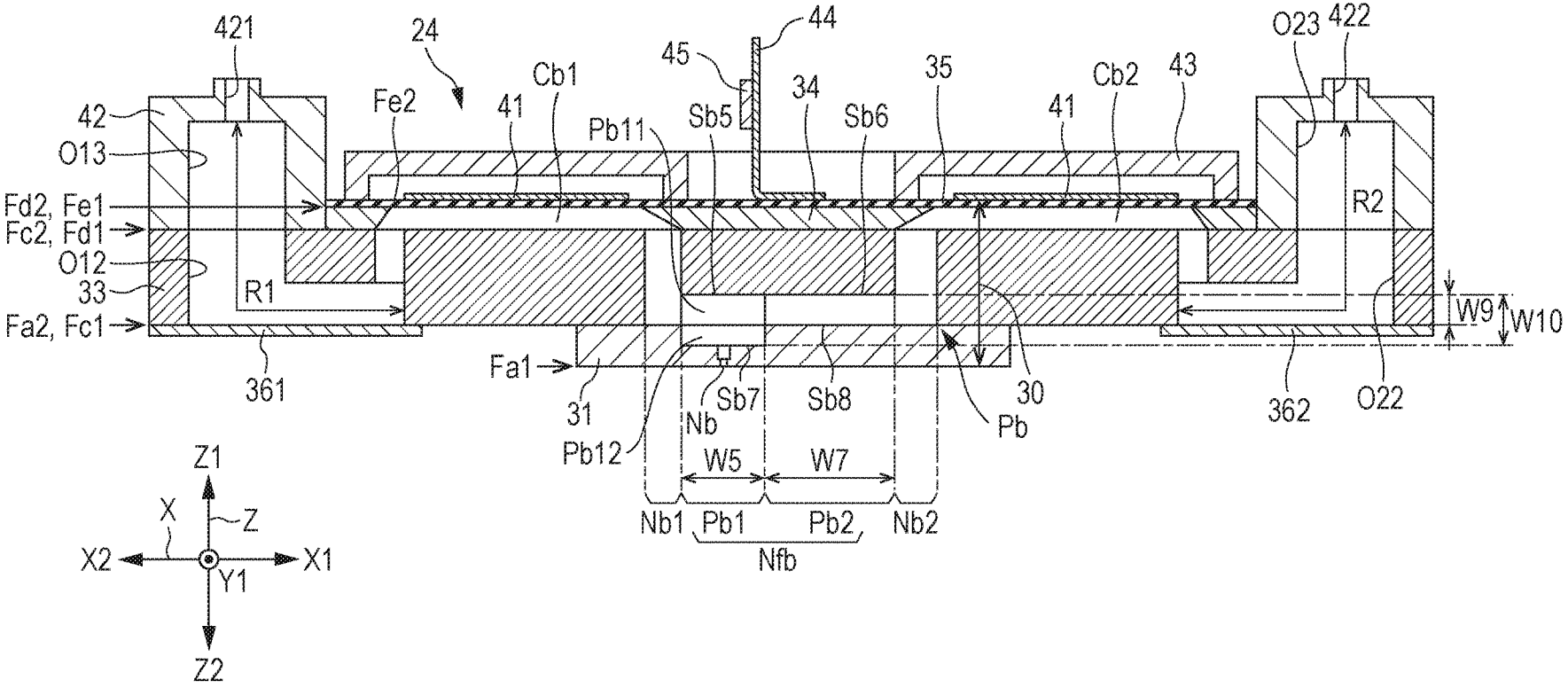
FIG. 18 is a cross-sectional view taken along line XVIII-XVIII in FIG. 14 according to the fourth embodiment.

FIG. 17 is a cross-sectional view taken along line XVII-XVII in FIG. 14. FIG. 18 is a cross-sectional view taken along line XVIII-XVIII in FIG. 14. Components similar to those of the first to third embodiments are given the same reference signs, and detailed descriptions thereof will be omitted or simplified.

The liquid ejecting head 24 of the fourth embodiment differs from the first embodiment in the configuration of the second portion Pa2 and the third portion Pb1. Specifically, the second portion Pa2 of the fourth embodiment includes a channel Pa21 provided in the communication plate 33 and extending in the X-axis direction by a predetermined amount and a channel Pa22 provided in the nozzle plate 31 and extending in the X-axis direction by a predetermined amount. The channel Pa22 is provided between the channel Pa21 and the nozzle Na in the nozzle plate 31 and communicates between the channel Pa21 and the nozzle Na. Likewise, the third portion Pb1 of the fourth embodiment includes a channel Pb11 provided in the communication plate 33 and extending in the X-axis direction by a predetermined amount and a channel Pb12 provided in the nozzle plate 31 and extending in the X-axis direction by a predetermined amount. The channel Pb12 is provided between the channel Pall and the nozzle Nb in the nozzle plate 31 and communicates between the channel Pall and the nozzle Nb.

The liquid ejecting head 24 of the fourth embodiment has the channel Pa22 in the nozzle plate 31, as shown in FIG. 17. Assuming that the side on which the pressure chamber Ca1 and the pressure chamber Ca2 are positioned in the Z1-direction as viewed from the nozzle channel Nfa is the first side, and the side on which the nozzle Na is positioned in the Z2-direction is the second side, a channel wall surface Sa7 of the first portion Pa1 on the second side and a channel wall surface Sa8 of the second portion Pa2 on the second side are at different positions in the Z2-direction, and a channel wall surface Sa5 of the first portion Pa1 on the first side and a channel wall surface Sa6 of the second portion Pa2 on the first side are at the same position in the Z1-direction. In other words, the first portion Pa1 has the channel wall surface Sa5 and the channel wall surface Sa. The channel wall surface Sa7 is positioned between the ink ejection surface of the nozzle Na and the channel wall surface Sa5 in the Z2-direction. Likewise, the second portion Pa2 has the channel wall surface Sa6 and the channel wall surface Sa8. The channel wall surface Sa8 is positioned between the ink ejection surface of the nozzle Na and the channel wall surface Sa6 in the Z2-direction.

Assuming that the side on which the pressure chamber Cb1 and the pressure chamber Cb2 are positioned in the Z1-direction as viewed from the nozzle channel Nfb is the first side, and the side on which the nozzle Nb is positioned in the Z2-direction is the second side, a channel wall surface Sb7 of the third portion Pb1 on the second side and a channel wall surface Sb8 of the fourth portion Pb2 on the second side are at different positions in the Z2-direction, and a channel wall surface Sb5 of the third portion Pb1 on the first side and a channel wall surface Sb6 of the fourth portion Pb2 on the first side are at the same position in the Z1-direction. In other words, the third portion Pb1 has the channel wall surface Sb5 and the channel wall surface Sb7. The channel wall surface Sb7 is positioned between the ink ejection surface of the nozzle Nb and the channel wall surface Sb5 in the Z2-direction. Likewise, the fourth portion Pb2 has the channel wall surface Sb6 and the channel wall surface Sb8. The channel wall surface Sb8 is positioned between the ink ejection surface of the nozzle Nb and the channel wall surface Sb6 in the Z2-direction.

In the fourth embodiment, the individual channels Pa and the individual channels Pb are 180° inverted about the Z-axis, and the nozzle channel Nfa and the nozzle channel Nfb overlap in side view. With this configuration, the channel Pa21 in the second portion Pa2 of the individual channel Pa overlaps completely with the fourth portion Pb2 in side view, and the channel Pa22 does not overlap with the fourth portion Pb2 and overlaps entirely with the nozzle plate 31 in side view. Likewise, the channel Pb11 in the third portion Pb1 of the individual channel Pb overlaps completely with the first portion Pa1 in side view, and the channel Pb12 does not overlap with the first portion Pa1 but overlaps entirely with the nozzle plate 31 in side view. In other words, the channel Pa22 is covered with the nozzle plate 31 from three directions, the Z1-direction, the Y1-direction, and the Y2-direction, and the channel Pb12 is also covered with the nozzle plate 31 from three directions, the Z1-direction, the Y1-direction, and the Y2-direction. The liquid ejecting head 24 of the fourth embodiment therefore provides the same operational advantage as in the first embodiment.

Fifth Embodiment

Figure 19:
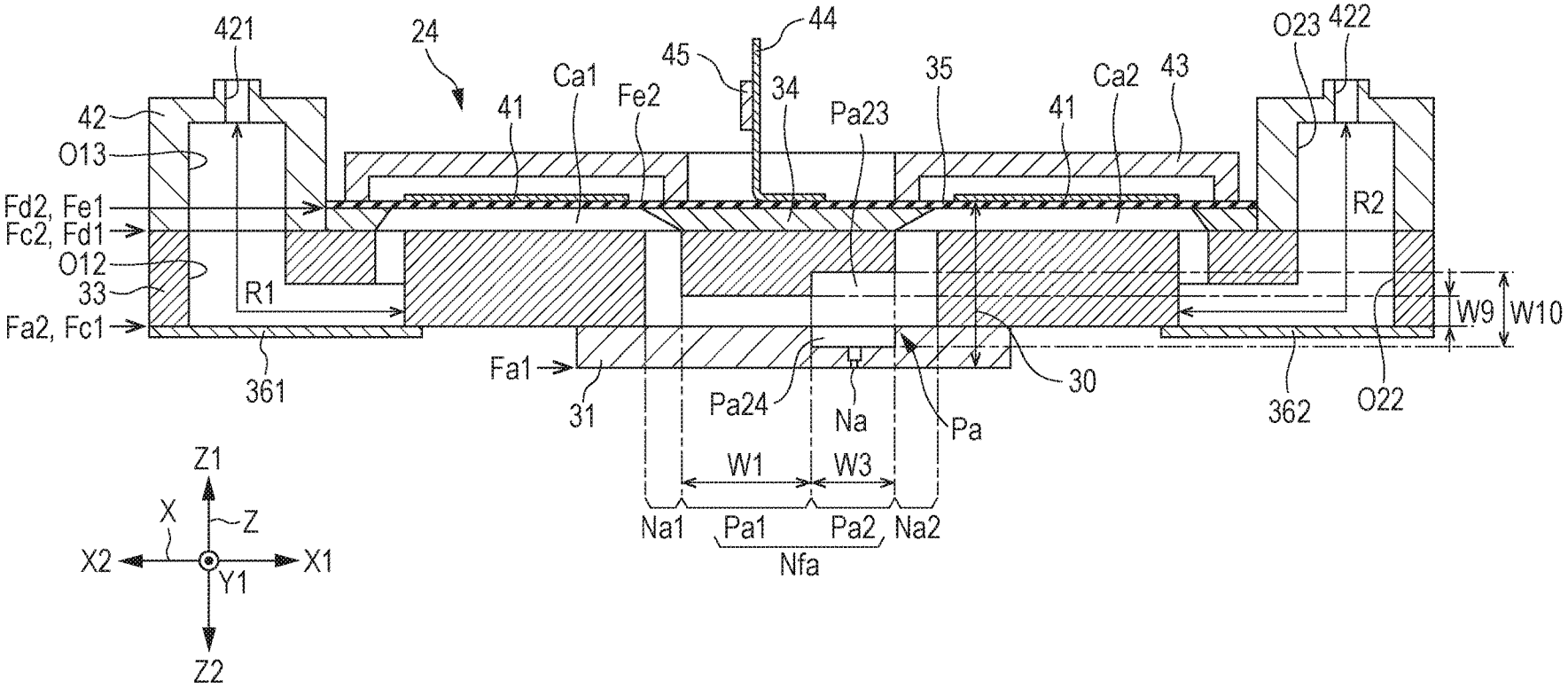
FIG. 19 is a cross-sectional view taken along line XIX-XIX in FIG. 14 according to a fifth embodiment.
Figure 20:
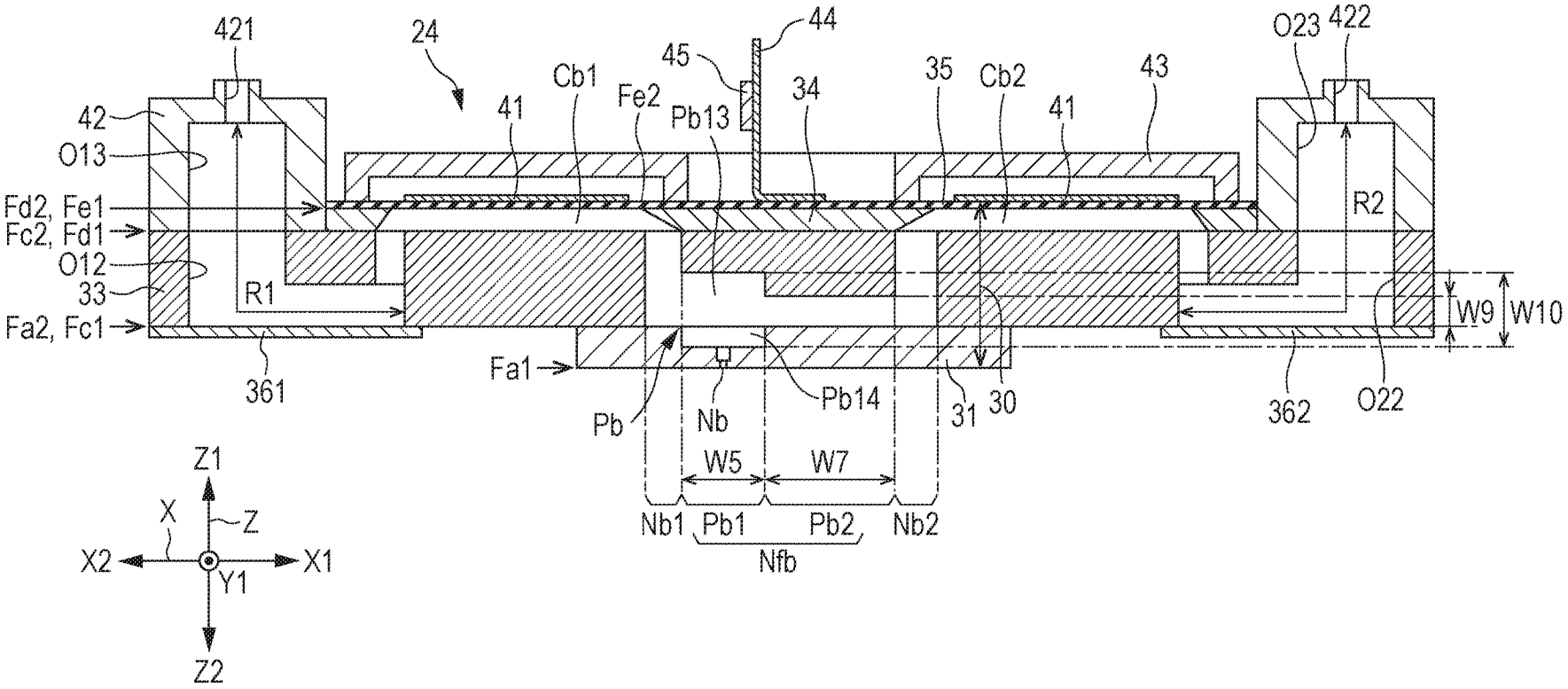
FIG. 20 is a cross-sectional view taken along line XX-XX in FIG. 14 according to the fifth embodiment.

FIG. 19 is a cross-sectional view taken along line XIX-XIX in FIG. 14 according to a fifth embodiment. FIG. 20 is a cross-sectional view taken along line XX-XX in FIG. 14 according to the fifth embodiment. The same components as those of the first to fourth embodiments are given the same reference signs, and descriptions thereof will be omitted or simplified.

The liquid ejecting head 24 of the fifth embodiment differs from the first embodiment in the configuration of the second portion Pa2 and the third portion Pb1. Specifically, the second portion Pa2 of the fifth embodiment includes a channel Pa23 and a channel Pa24. The channel Pa23 is a channel positioned between the first portion Pa1 and the second communication channel Na2 in the X-axis direction and extending in the X-axis direction and the Z-axis direction by a predetermined amount. The channel Pa23 is a channel communicating between the first portion Pa1 and the second communication channel Na2. The channel Pa24 is provided in the nozzle plate 31 and extends in the X-axis direction by a predetermined amount. The channel Pa24 is provided between the channel Pa23 and the nozzle Na in the nozzle plate 31 and communicates between the channel Pa23 and the nozzle Na. Likewise, the third portion Pb1 of the fifth embodiment includes a channel Pb13 and a channel Pb14. The channel Pb13 is a channel positioned between the fourth portion Pb2 and the third communication channel Nb1 in the X-axis direction and extending in the X-axis direction and the Z-axis direction by a predetermined amount. The channel Pb13 is a channel communicating between the fourth portion Pb2 and the third communication channel Nb1. The channel Pb14 is provided in the nozzle plate 31 and extends in the X-axis direction by a predetermined amount. The channel Pb14 is provided between the channel Pb13 and the nozzle Nb in the nozzle plate 31 and communicates between the channel Pb13 and the nozzle Nb.

The width W10 of the second portion Pa2 of the fifth embodiment in the Z1-direction is larger than three times the width W9 of the first portion Pa1 in the Z1-direction. Likewise, the width W10 of the third portion Pb1 of the fifth embodiment is larger than three times the width W9 of the fourth portion Pb2.

In the fifth embodiment, the individual channels Pa and the individual channels Pb are 180° inverted about the Z-axis, and the nozzle channel Nfa and the nozzle channel Nfb overlap in side view. Thus, the channel Pa23 in the second portion Pa2 of the individual channel Pa has a portion that overlaps completely with the fourth portion Pb2 in side view and a portion not overlapping therewith, and the channel Pa24 does not overlap with the fourth portion Pb2 in side view but overlaps entirely with the nozzle plate 31. Likewise, the channel Pb13 in the third portion Pb1 of the individual channel Pb has a portion that overlaps completely with the first portion Pa1 in side view and a portion not overlapping therewith, and the channel Pb14 does not overlap with the first portion Pa1 in side view but overlaps entirely with the nozzle plate 31. The liquid ejecting head 24 of the fifth embodiment therefore provides the same operational advantage as in the first embodiment.

Sixth Embodiment

Figure 21:
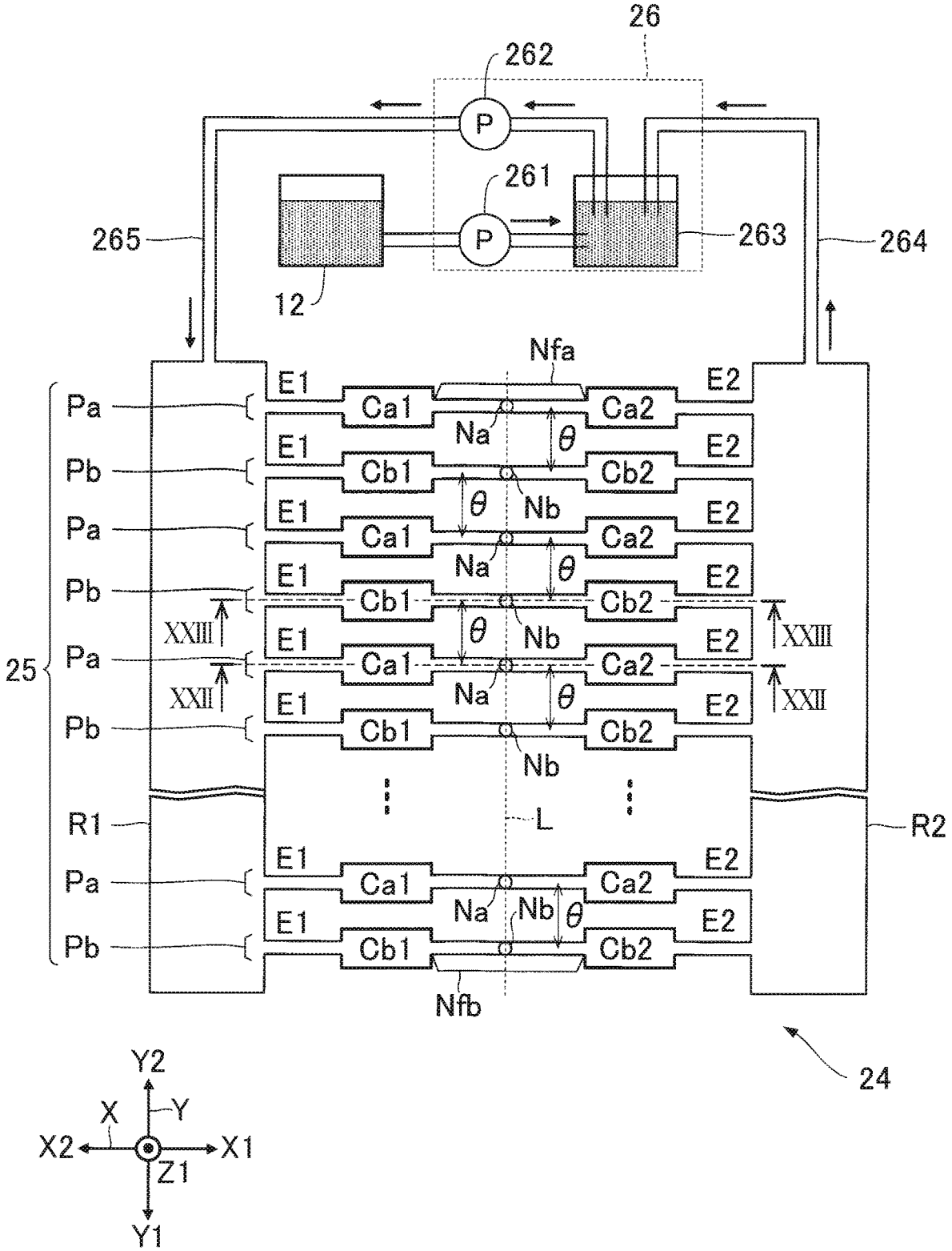
FIG. 21 is a schematic diagram illustrating a channel structure in a liquid ejecting head according to a sixth embodiment.
Figure 22:
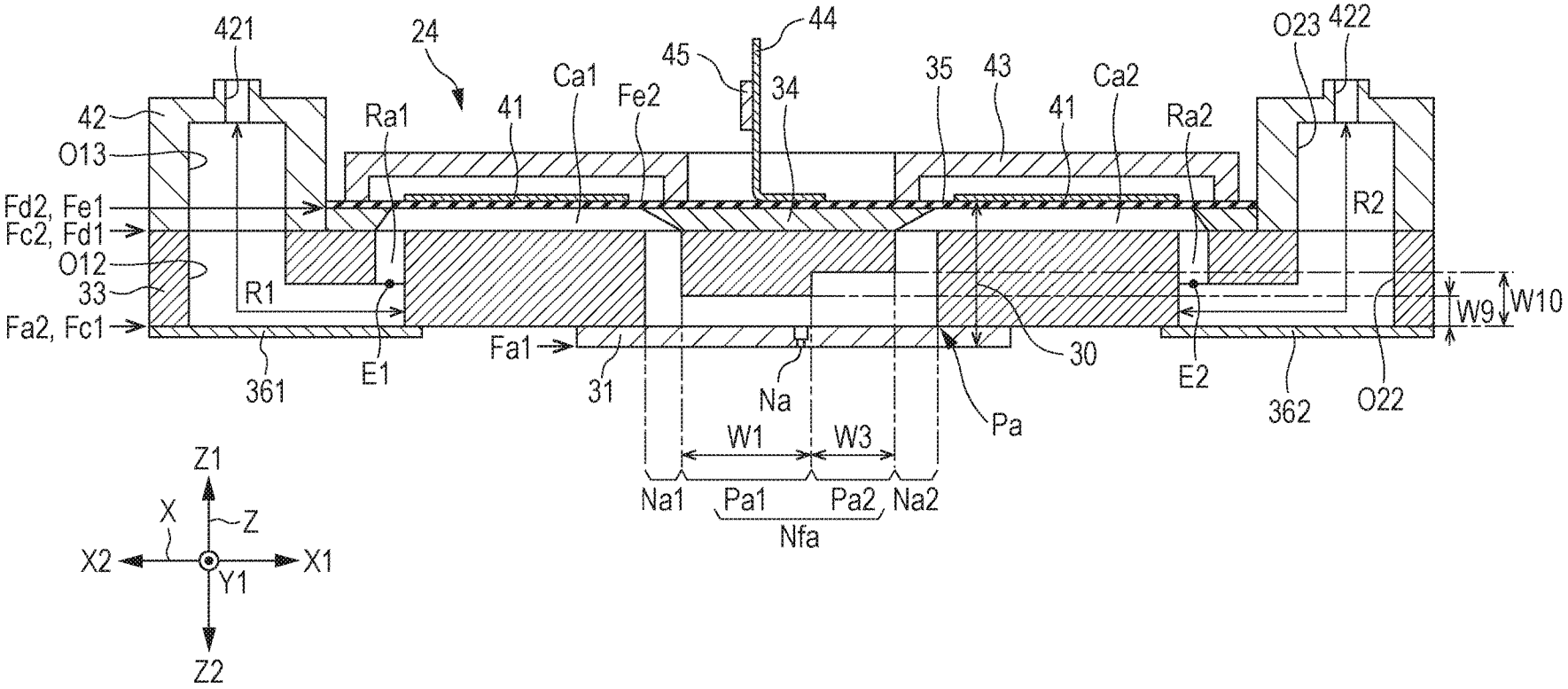
FIG. 22 is a cross section taken along line XXII-XXII in FIG. 21.
Figure 23:
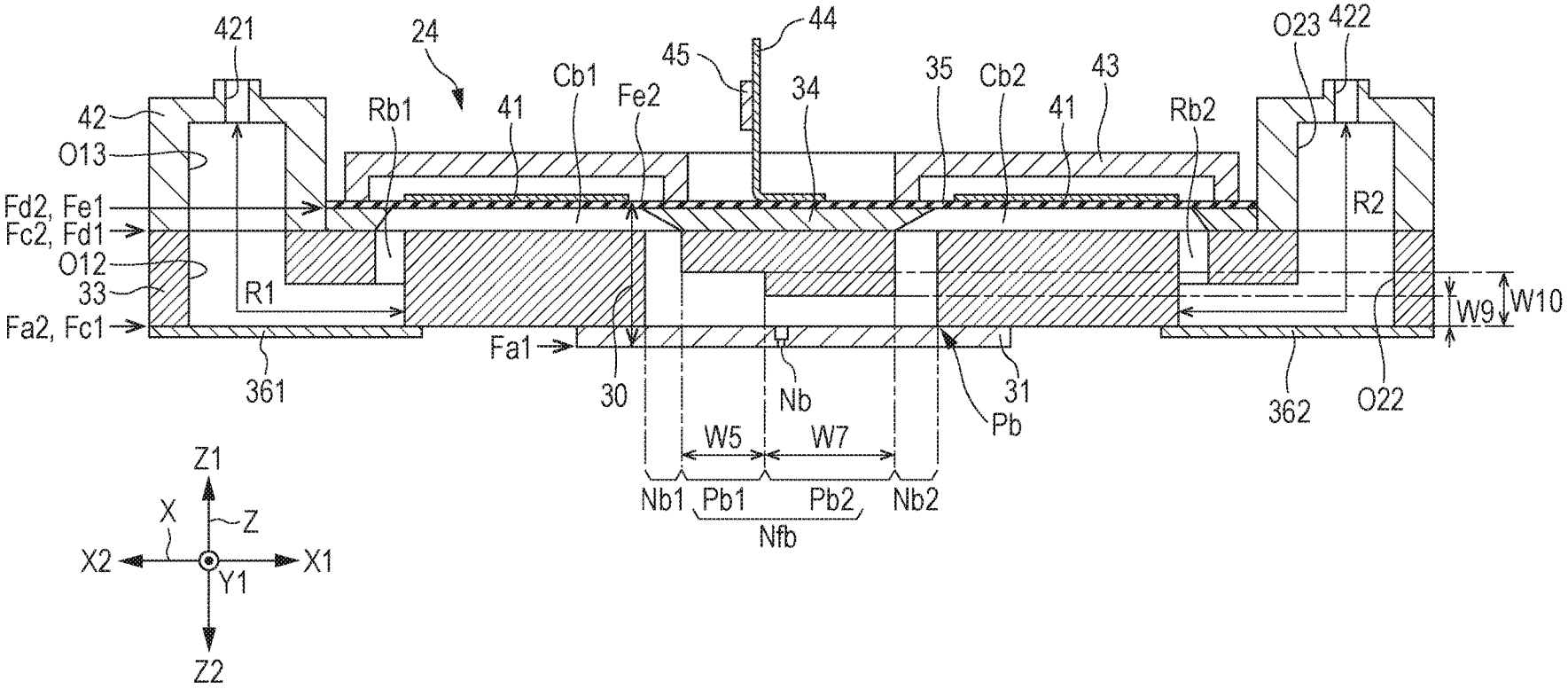
FIG. 23 is a cross-sectional view taken along line XXIII-XXIII in FIG. 21.

FIG. 21 is a schematic diagram illustrating a channel structure in a liquid ejecting head 24 according to a sixth embodiment as viewed in the Z-axis direction. FIG. 22 is a cross section taken along line XXII-XXII in FIG. 21. FIG. 23 is a cross-sectional view taken along line XXIII-XXIII in FIG. 21. The same components as those of the first to fifth embodiments are given the same reference signs, and descriptions thereof will be omitted or simplified.

The liquid ejecting head 24 of the sixth embodiment differs from the first embodiment in the positions of the nozzle Na and the nozzle Nb. Specifically, the nozzle Na of the sixth embodiment is disposed at the center of the nozzle plate 31 in the X-axis direction, as shown in FIG. 22. The nozzle Na is disposed in the vicinity of an end of the first portion Pa1 in the X1-direction, as shown in FIG. 22. Likewise, the nozzle Nb of the sixth embodiment is disposed at the center of the nozzle plate 31 in the X-axis direction, as shown in FIG. 23. The nozzle Nb is disposed in the vicinity of an end of the fourth portion Pb2 in the X2-direction.

As shown in FIG. 21, the multiple nozzles Na and the multiple nozzles Nb of the sixth embodiment are positioned on the same straight line to constitute a nozzle array L. The nozzle array L is an aggregate of the multiple nozzles Na and the multiple nozzles Nb arrayed on the straight line along the Y-axis. The nozzles Na and the nozzles Nb are positioned at the same position in the X1-direction, as shown in FIG. 21. As shown in FIG. 21, the nozzles N including the nozzles Na and the nozzles Nb are arrayed at a pitch of θ. The pitch θ is the distance between the center of the nozzle Na and the center of the nozzle Nb in the Y-axis direction.

In the sixth embodiment, the individual channels Pa and the individual channels Pb are 180° inverted about the Z-axis, and the nozzle channel Nfa and the nozzle channel Nfb overlap in side view. Thus, the second portion Pa2 of the individual channel Pa has a portion that overlaps completely with the fourth portion Pb2 in side view and a portion not overlapping therewith. The third portion Pb1 of the individual channel Pb has a portion that overlaps completely with the first portion Pa1 in side view and a portion not overlapping therewith. The liquid ejecting head 24 of the sixth embodiment therefore provides the same operational advantage as in the first embodiment.

Seventh Embodiment

Figure 24:
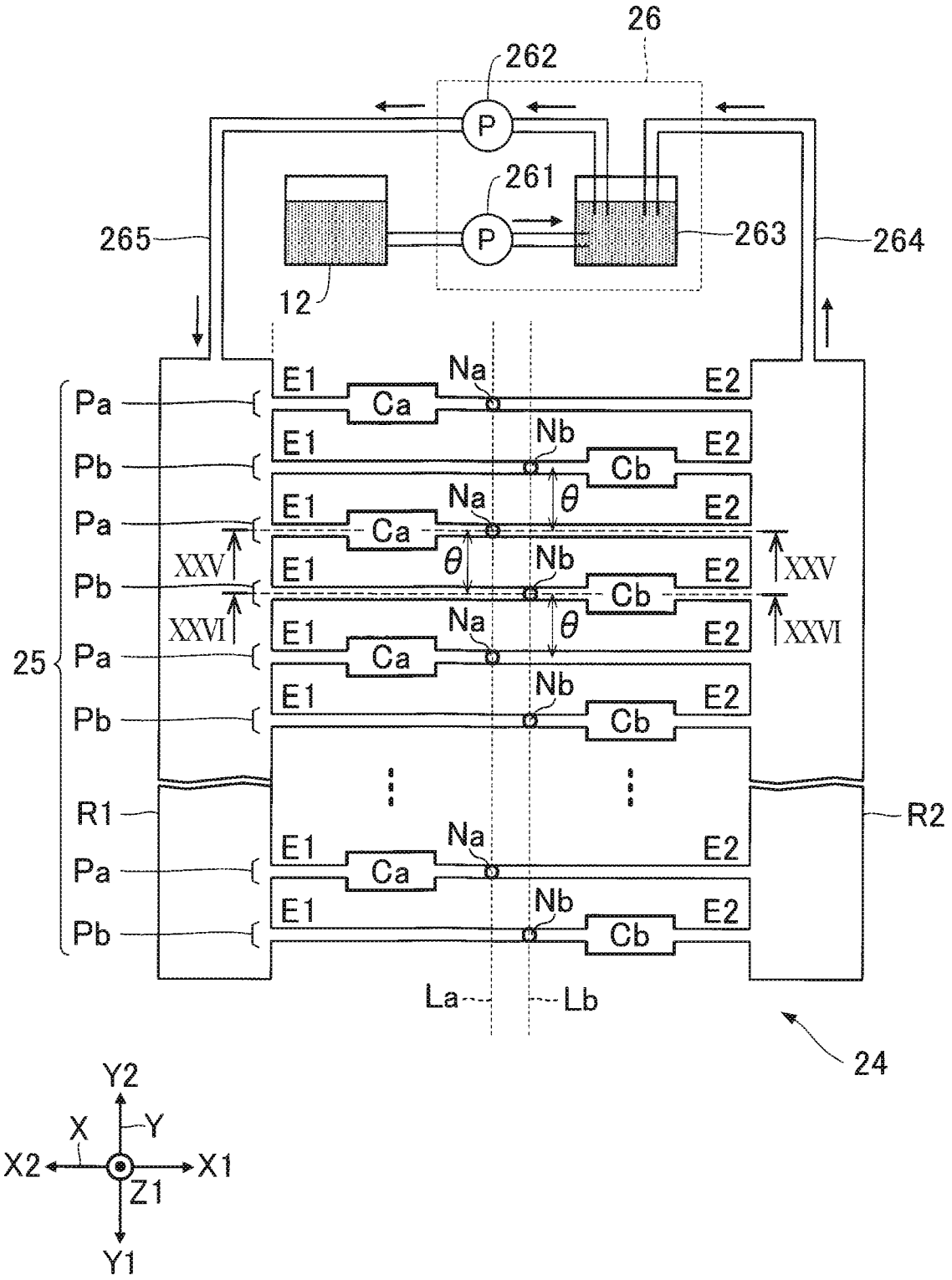
FIG. 24 is a schematic diagram illustrating a channel structure in a liquid ejecting head according to a seventh embodiment.

FIG. 24 is a schematic diagram illustrating a channel structure in a liquid ejecting head 24 according to a seventh embodiment when viewed in the Z-axis direction. As shown in FIG. 24, multiple nozzles N (Na and Nb) are formed on a surface of the liquid ejecting head 24 facing the medium 11. The multiple nozzles N are arrayed along the Y-axis. Ink is ejected from each of the nozzles N in the Z-axis direction. In other words, the Z-axis corresponds to a direction in which ink is ejected from the nozzles N.

The nozzles N in the seventh embodiment are divided into a first nozzle array La and a second nozzle array Lb. The first nozzle array La is an aggregate of the multiple nozzles Na arrayed linearly along the Y-axis. Likewise, the second nozzle array Lb is an aggregate of the multiple nozzles Nb arrayed linearly along the Y-axis. The first nozzle array La and the second nozzle array Lb are disposed in parallel in the X-axis, with a space therebetween. The position of each nozzle Na in the Y-axis direction and the position of each nozzle Nb in the Y-axis direction differ. As shown in FIG. 24, the nozzles N including the nozzles Na and the nozzles Nb are arrayed at a pitch (cycle) of θ. The pitch θ is the distance between the center of the nozzle Na and the center of the nozzle Nb in the Y-axis direction.

As illustrated in FIG. 24, the liquid ejecting head 24 includes an individual channel array 25. The individual channel array 25 is an aggregation of multiple individual channels P (Pa and Pb) corresponding to different nozzles N. Each of the multiple individual channels P is a channel communicating with a nozzle N corresponding to the individual channel P. The individual channels P extend along the X-axis. The individual channel array 25 is constituted by the multiple individual channels P arranged in parallel along the Y-axis. Although, in FIG. 24, each individual channels P is a simple straight line, the actual shape of the individual channel P will be described later.

Each individual channel P includes a pressure chamber C (Ca or Cb). The pressure chamber C in each individual channel P is a space that stores the ink ejected from the nozzle N communicating with the individual channel P. In other words, the ink is ejected from the nozzle N as the pressure of the ink in the pressure chamber C changes.

As illustrated in FIG. 24, the liquid ejecting head 24 includes a first common liquid chamber R1 and a second common liquid chamber R2. The first common liquid chamber R1 and the second common liquid chamber R2 extend in the Y-axis direction across the entire area in which the multiple nozzles N are distributed. The individual channel array 25 and the nozzles N are located between the first common liquid chamber R1 and the second common liquid chamber R2 in plan view.

The multiple individual channels P communicate, in common, with the first common liquid chamber R1. Specifically, an end E1 of each individual channel P in the X2-direction is coupled to the first common liquid chamber R1. Likewise, the multiple individual channels P communicate, in common, with the second common liquid chamber R2. Specifically, an end E2 of each individual channel P in the X1-direction is coupled to the second common liquid chamber R2. As will be understood from the above description, the individual channels P communicate between the first common liquid chamber R1 and the second common liquid chamber R2. This allows the ink supplied from the first common liquid chamber R1 to the individual channels P to be ejected through the nozzles N corresponding to the individual channels P. Of the ink supplied from the first common liquid chamber R1 to the individual channels P, the ink that was not ejected from the nozzles N is discharged into the second common liquid chamber R2.

The liquid ejecting apparatus 100 according to the seventh embodiment includes a circulating mechanism 26, as shown in FIG. 24. The circulating mechanism 26 is a mechanism for circulating the ink discharged from the individual channels P into the second common liquid chamber R2 back to the first common liquid chamber R1. Specifically, the circulating mechanism 26 includes a first supply pump 261, a second supply pump 262, a reserve container 263, a circulation channel 264, and a supply channel 265.

The first supply pump 261 is a pump that supplies the ink stored in the liquid container 12 to the reserve container 263. The reserve container 263 is a subtank that temporarily stores the ink supplied from the liquid container 12. The circulation channel 264 is a channel that communicates between the second common liquid chamber R2 and the reserve container 263. The reserve container 263 is supplied with the ink stored in the liquid container 12 by the first supply pump 261 and is also supplied with the ink discharged from the individual channels P into the second common liquid chamber R2, through the circulation channel 264. The second supply pump 262 is a pump that pumps out the ink stored in the reserve container 263. The ink pumped out by the second supply pump 262 is supplied to the first common liquid chamber R1 through the supply channel 265.

The individual channels P of the individual channel array 25 include the individual channels Pa and the individual channels Pb. Each of the individual channels Pa is an individual channel P communicating with corresponding one of the nozzles Na in the first nozzle array La. Each of the individual channels Pb is an individual channel P communicating with corresponding one of the nozzles Nb in the second nozzle array Lb. The individual channels Pa and the individual channels Pb are alternately arrayed along the Y-axis. Thus, the individual channels Pa and the individual channels Pb are adjacent to each other in the Y-axis direction.

As will be understood from the above description, the multiple pressure chambers Ca for the different nozzles Na of the first nozzle array La are arrayed linearly along the Y-axis. Likewise, the multiple pressure chambers Cb for the different nozzles Nb of the second nozzle array Lb are arrayed linearly along the Y-axis. The array of multiple pressure chambers Ca and the array of multiple pressure chambers Cb are arranged in parallel in the X-axis direction, with a predetermined space therebetween. The positions of the pressure chambers Ca in the Y-axis direction and the positions of the pressure chambers Cb in the Y-axis direction differ.

Figure 25:
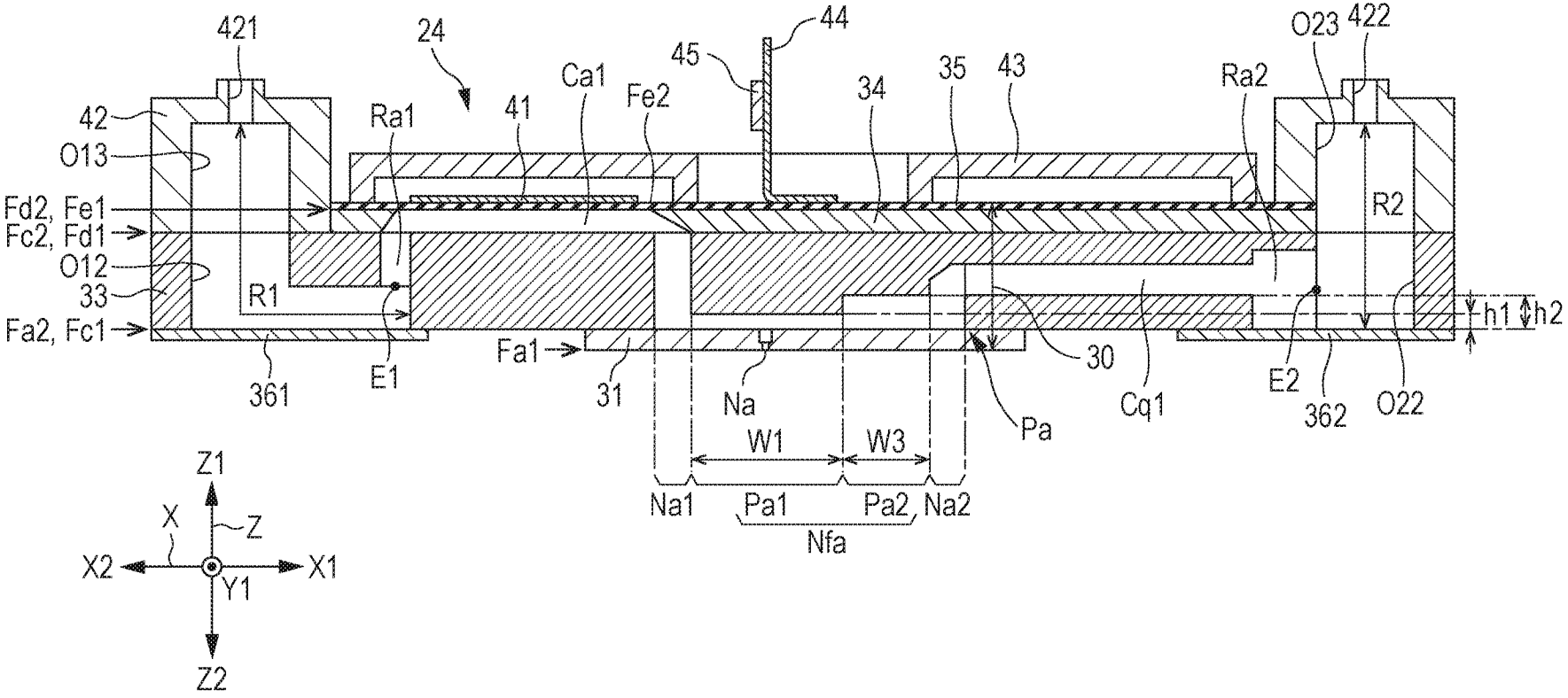
FIG. 25 is a cross-sectional view taken along line XXV-XXV in FIG. 24.
Figure 26:
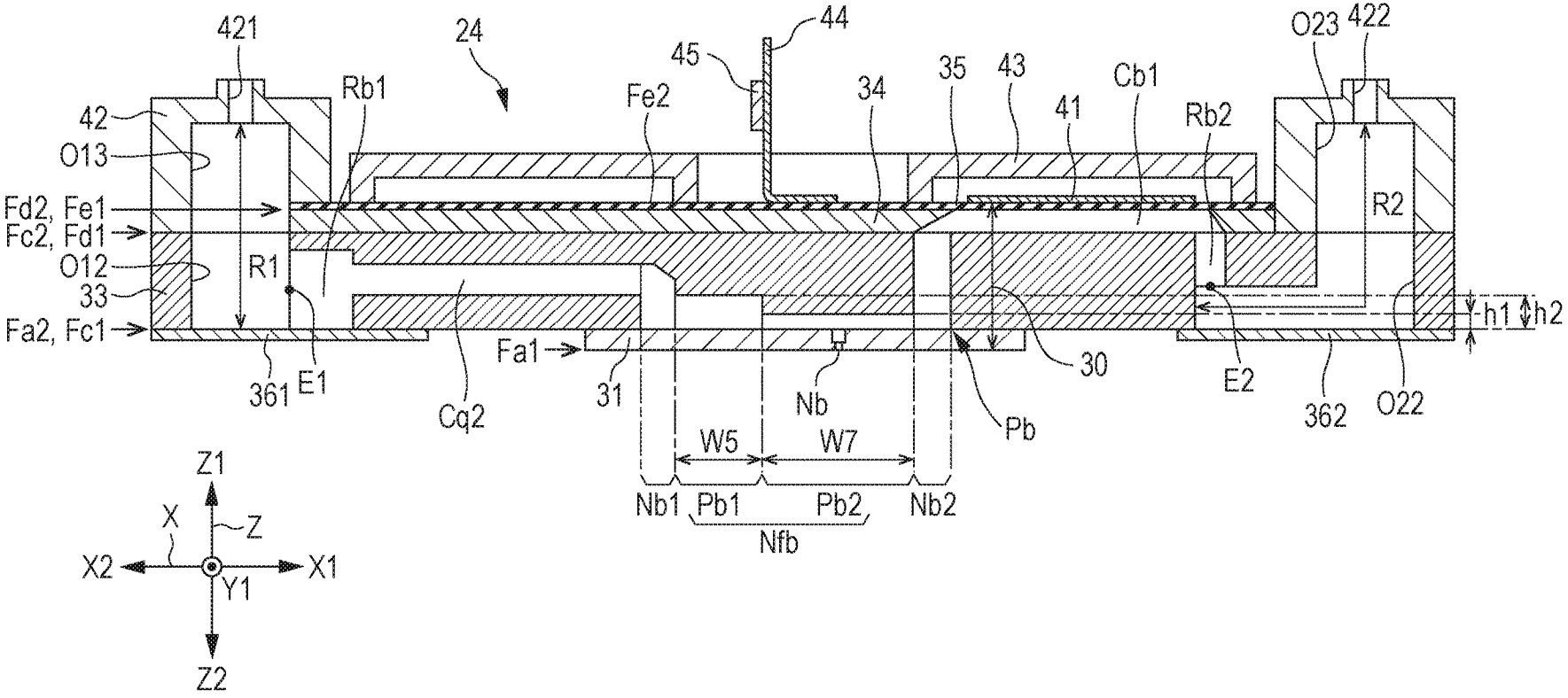
FIG. 26 is a cross-sectional view taken along line XXVI-XXVI in FIG. 24.

The specific configuration of the liquid ejecting head 24 according to the seventh embodiment will be described in detail hereinbelow. FIG. 25 is a cross-sectional view taken along line XXV-XXV in FIG. 24. FIG. 26 is a cross-sectional view taken along line XXVI-XXVI in FIG. 24. FIG. 25 illustrates a cross section passing through the individual channel Pa. FIG. 26 illustrates a cross section passing through the individual channel Pb.

As illustrated in FIGS. 25 and 26, the liquid ejecting head 24 includes a channel structure 30, a piezoelectric element 41, a casing 42, a protective substrate 43, and a wiring substrate 44. The channel structure 30 is a structure in which the first common liquid chamber R1, the second common liquid chamber R2, the individual channels P, and channels including the nozzles N are formed.

The channel structure 30 is a structure in which a nozzle plate 31, a communication plate 33, a pressure chamber substrate 34, and a vibration plate 35 are layered in this order in the Z1-direction. These components constituting the channel structure 30 are produced by processing a silicon monocrystal substrate by, for example, a general processing method for producing a semiconductor.

The nozzle plate 31 has the multiple nozzles N formed therein. Each of the nozzles N is a cylindrical through-hole through which the ink is to be passed. The nozzle plate 31 of the seventh embodiment is a plate-like member having a surface Fa1 positioned in the Z2-direction and a surface Fa2 positioned in the Z1-direction.

Figure 27:
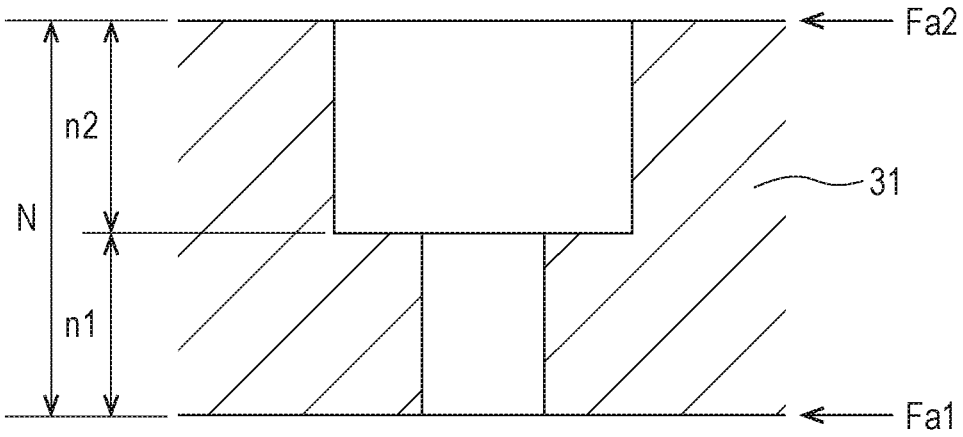
FIG. 27 is an enlarged cross-sectional view of any one nozzle.

FIG. 27 is an enlarged cross-sectional view of any one nozzle N. As illustrated in FIG. 27, one nozzle N includes a first section n1 and a second section n2. The first section n1 is a section of the nozzle N including an opening through which ink is ejected. In other words, the first section n1 is a section contiguous to the surface Fa1 of the nozzle plate 31. The second section n2 is a section between the first section n1 and the individual channel P. In other words, the second section n2 is a section contiguous to the surface Fa2 of the nozzle plate 31. The second section n2 has a larger diameter than that of the first section n1.

The communication plate 33 shown in FIGS. 25 and 26 is a plate-like member including a surface Fc1 positioned in the Z2-direction and a surface Fc2 positioned in the Z1-direction.

The pressure chamber substrate 34 is a plate-like member including a surface Fd1 positioned in the Z2-direction and a surface Fd2 positioned in the Z1-direction. The vibration plate 35 is a plate-like member including a surface Fe1 positioned in the Z2-direction and a surface Fe2 positioned in the Z1-direction.

The components constituting the channel structure 30 are each formed in a rectangular shape that is long in the Y-axis direction and are bonded to each other with, for example, an adhesive. For example, the surface Fa2 of the nozzle plate 31 is bonded to the surface Fc1 of the communication plate 33, and the surface Fc2 of the communication plate 33 is bonded to the surface Fd1 of the pressure chamber substrate 34. The surface Fd2 of the pressure chamber substrate 34 is bonded to the surface Fe1 of the vibration plate 35.

The communication plate 33 has a space O12 and a space O22. Each of the space O12 and the space O22 is an opening that is long in the Y-axis direction. On the surface Fc1 of the communication plate 33, a vibration absorber 361 that closes the space O12 and a vibration absorber 362 that closes the space O22 are disposed. The vibration absorber 361 and the vibration absorber 362 are layered members made of an elastic material.

The casing 42 is a case for storing ink. The casing 42 is joined to the surface Fc2 of the communication plate 33. The casing 42 has a space O13 communicating with the space O12 and a space O23 communicating with the space O22. Each of the space O13 and the space O23 is a space that is long in the Y-axis direction. The space O12 and the space O13 communicate with each other to form the first common liquid chamber R1. Likewise, the space O22 and the space O23 communicate with each other to form the second common liquid chamber R2. The vibration absorber 361 constitutes a wall surface of the first common liquid chamber R1 and absorbs a pressure change of the ink in the first common liquid chamber R1. The vibration absorber 362 constitutes a wall surface of the second common liquid chamber R2 and absorbs a pressure change of the ink in the second common liquid chamber R2.

The casing 42 has a supply port 421 and a discharge port 422. The supply port 421 is a conduit communicating with the first common liquid chamber R1 and is coupled to the supply channel 265 of the circulating mechanism 26. The ink pumped out by the second supply pump 262 into the supply channel 265 is supplied to the first common liquid chamber R1 through the supply port 421. The discharge port 422 is a conduit communicating with the second common liquid chamber R2 and is coupled to the circulation channel 264 of the circulating mechanism 26. The ink in the second common liquid chamber R2 is supplied to the circulation channel 264 through the discharge port 422.

The pressure chamber substrate 34 has multiple pressure chambers C (Ca and Cb). Each pressure chamber C is a space between the surface Fc2 of the communication plate 33 and the surface Fe1 of the vibration plate 35. The pressure chamber C is long along the X-axis in plan view.

The vibration plate 35 is an elastically vibratile plate-like member. The vibration plate 35 is a lamination of, for example, a first layer made of silicon oxide (SiO2) and a second layer made of zirconium oxide (ZrO2). The vibration plate 35 and the pressure chamber substrate 34 may be integrally formed by selectively removing, in the thickness direction, a part of the plate-like member with a predetermined thickness corresponding to the pressure chamber C. The vibration plate may be of a single layer.

On the surface Fe2 of the vibration plate 35, the piezoelectric elements 41 for the different pressure chambers C are disposed. The piezoelectric elements 41 for the individual pressure chambers C overlap with the pressure chambers C in plan view. Specifically, each piezoelectric element 41 is a lamination of a first electrode and a second electrode facing each other and a piezoelectric layer formed between the electrodes. The piezoelectric element 41 is an energy generating element that ejects the ink in the pressure chamber C through the nozzle N by changing the pressure of the ink in the pressure chamber C. In other words, the piezoelectric element 41 is deformed by receiving a driving signal to vibrate the vibration plate 35, and the pressure chamber C is expanded and contracted by the vibration of the vibration plate 35, and the ink is ejected from the nozzles N. The pressure chambers C (Ca and Cb) are each defined as a range of the individual channel P in which the vibration plate 35 is vibrated as the piezoelectric element 41 is deformed.

The protective substrate 43 is a plate-like member disposed on the surface Fe2 of the vibration plate 35. The protective substrate 43 protects the piezoelectric elements 41 and also reinforces the mechanical strength of the vibration plate 35. The piezoelectric elements 41 are housed between the protective substrate 43 and the vibration plate 35. The wiring substrate 44 is disposed on the surface Fe2 of the vibration plate. The wiring substrate 44 is a surface-mounted component for electrically coupling the control unit 21 and the liquid ejecting head 24 together. Preferable examples of the wiring substrate 44 include a flexible printed circuit (FPC) and a flexible flat cable (FFC). On the wiring substrate 44, a driving circuit 45 for supplying a driving signal to each piezoelectric element 41 is mounted.

Next, the details of the configuration of the individual channels P will be described. The shape of the individual channel Pa and the shape of the individual channel Pb have a rotationally symmetrical relationship about the axis of symmetry parallel to the Z-axis in plan view.

As shown in FIG. 25, the individual channel Pa includes a supply channel Ra1, a pressure chamber Ca1, a first communication channel Na1, a nozzle channel Nfa, a second communication channel Na2, a lateral communication channel Cq1, and a discharge channel Ra2. The individual channel Pa is a channel in which these elements are integrated and coupled in the above order.

The supply channel Ra1 is a space formed in the communication plate 33. Specifically, as shown in FIG. 25, the supply channel Ra1 extends from the space O12 constituting the first common liquid chamber R1 to the surface Fc2 of the communication plate 33 along the Z-axis. An end of the supply channel Ra1 coupled to the space O12 is the end E1 of the individual channel Pa. The supply channel Ra1 is a channel communicating with the pressure chamber Ca1 to introduce the ink supplied from the first common liquid chamber R1 into the pressure chamber Ca1. The supply channel Ra1 is an example of "first individual supply channel".

As shown in FIG. 25, the first communication channel Na1 is a space passing through the communication plate 33. The first communication channel Na1 is a channel extending along the Z-axis. The first communication channel Na1 extends in the Z1-direction to communicate between the pressure chamber Ca1 and the nozzle channel Nfa. The first communication channel Na1 is a channel that introduces the ink expelled from the pressure chamber Ca1 into the nozzle channel Nfa.

The nozzle channel Nfa is a channel provided in the communication plate 33 and extending in the X-axis direction. As shown in FIG. 25, the nozzle channel Nfa is segmented into a first portion Pa1 and a second portion Pa2. The first portion Pa1 is a channel positioned between the first communication channel Na1 and the second portion Pa2 in the X-axis direction and extending in the X-axis direction. The second portion Pa2 is a channel positioned between the first portion Pa1 and the second communication channel Na2 in the X-axis direction and extending in the X-axis direction. The nozzle Na is disposed in the first portion Pa1.

The width h1 of the first portion Pa1 in the Z-axis direction is smaller than the width h2 of the second portion Pa2 in the Z-axis direction. The width W1 of the first portion Pa1 in the X1-direction is larger than the width W3 of the second portion Pa2 in the X1-direction, as shown in FIG. 25.

The second communication channel Na2 is a space provided in the communication plate 33. The second communication channel Na2 is a channel extending along the Z-axis. The second communication channel Na2 extends in the Z1-direction to communicate between the lateral communication channel Cq1 and the nozzle channel Nfa. The second communication channel Na2 is a channel that introduces the ink supplied from the second portion Pa2 into the lateral communication channel Cq1.

The lateral communication channel Cq1 is a space provided in the communication plate 33. The lateral communication channel Cq1 is a long channel extending in the X-axis. The lateral communication channel Cq1 extends in the X1-direction to communicate between the second communication channel Na2 and the discharge channel Ra2. The lateral communication channel Cq1 is a channel that introduces the ink introduced from the second communication channel Na2 into the discharge channel Ra2.

The discharge channel Ra2 is a space formed in the communication plate 33. An end of the discharge channel Ra2 coupled to the space O22 is an end E2 of the individual channel Pa. The discharge channel Ra2 is a channel communicating with the lateral communication channel Cq1 to introduce the ink introduced from the lateral communication channel Cq1 into the second common liquid chamber R2. The discharge channel Ra2 is an example of "first individual discharge channel".

As shown in FIG. 26, the individual channels Pb includes a supply channel Rb1, a lateral communication channel Cq2, a third communication channel Nb1, a nozzle channel Nfb, a fourth communication channel Nb2, a pressure chamber Cb1, and a discharge channel Rb2. The individual channel Pb is a channel in which these elements are integrated and coupled in the above order.

The supply channel Rb1 is a space formed in the communication plate 33. An end of the supply channel Rb1 coupled to the space O12 is the end E1 of the individual channel Pb. The supply channel Rb1 is a channel communicating with the lateral communication channel Cq2 to introduce the ink supplied from the first common liquid chamber R1 into the lateral communication channel Cq2. The supply channel Rb1 is an example of "second individual supply channel".

The lateral communication channel Cq2 is a space provided in the communication plate 33. The lateral communication channel Cq2 is a long channel extending along the X-axis. The lateral communication channel Cq2 extends in the X1-direction to communicate between the supply channel Rb1 and the third communication channel Nb1. The lateral communication channel Cq1 is a channel that introduces the ink introduced from the supply channel Rb1 into the third communication channel Nb1.

The third communication channel Nb1 is a space provided in the communication plate 33, as shown in FIG. 26. The third communication channel Nb1 is a channel extending along the Z-axis. The third communication channel Nb1 extends in the Z1-direction to communicate between the lateral communication channel Cq2 and the nozzle channel Nfb. The third communication channel Nb1 is a channel that introduces the ink introduced from the lateral communication channel Cq2 into the nozzle channel Nfb.

The nozzle channel Nfb is a channel provided in the communication plate 33 and extending in the X-axis direction. As shown in FIG. 26, the nozzle channel Nfb is segmented into a third portion Pb1 and a fourth portion Pb2. The third portion Pb1 is a channel positioned between the third communication channel Nb1 and the fourth portion Pb2 in the X-axis direction and extending in the X-axis direction. The fourth portion Pb2 is a channel positioned between the third portion Pb1 and the fourth communication channel Nb2 in the X-axis direction and extending in the X-axis direction. The nozzle Nb is disposed in the fourth portion Pb2.

The width h2 of the third portion Pb1 in the Z-axis direction is larger than the width h1 of the fourth portion Pb2 in the Z-axis direction. The width W5 of the third portion Pb1 in the X1-direction is smaller than the width W7 of the fourth portion Pb2 in the X1-direction, as shown in FIG. 26.

The fourth communication channel Nb2 is a space passing through the communication plate 33. The fourth communication channel Nb2 is a channel extending along the Z-axis. The fourth communication channel Nb2 extends in the Z1-direction to communicate between the pressure chamber Cb1 and the nozzle channel Nfb. The fourth communication channel Nb2 is a channel that introduces the ink supplied from the nozzle channel Nfb into the pressure chamber Cb1.

The discharge channel Rb2 is a space formed in the communication plate 33. Specifically, as shown in FIG. 26, the discharge channel Rb2 extends from the space O22 constituting the second common liquid chamber R2 to the surface Fc2 of the communication plate 33 along the Z-axis. An end of the discharge channel Rb2 coupled to the space O22 is the end E2 of the individual channel Pb. The discharge channel Rb2 is a channel communicating with the pressure chamber Cb1 to introduce the ink expelled from the pressure chamber Cb1 into the second common liquid chamber R2. The discharge channel Rb2 is an example of "second individual discharge channel".

In FIGS. 25 and 26, for the individual channel Pa and the individual channel Pb adjacent to each other, the pressure chamber Ca1 and the lateral communication channel Cq1 of the individual channel Pa have no channel at adjacent positions in the Y-axis direction, and the pressure chamber Cb1 and the lateral communication channel Cq2 of the individual channel Pb also have no channel at adjacent positions in the Y-axis direction. This configuration reduces the tendency to cause structural crosstalk even if the pitch θ is decreased, as compared with the sixth embodiment. This allows for decreasing the pitch θ to increase the nozzle resolution in the Z-axis direction, allowing recording a high-quality image. Although, in this embodiment, the first communication channel Na1 and the third communication channel Nb1 are at the same position in the X-axis direction, the first communication channel Na1 and the third communication channel Nb1 may be disposed at different positions. This also applies to the second communication channel Na2 and the fourth communication channel Nb2. Disposing these channels at different positions reduces or eliminates the structural crosstalk between the first communication channel Na1 and the third communication channel Nb1 and between the second communication channel Na2 and the fourth communication channel Nb2, allowing the pitch θ to be decreased more.

In this embodiment, the nozzle channel Nfa has the first portion Pa1 with a width that is small in the Z-axis direction and the second portion Pa2 with a width that is large in the Z-axis direction, as described above. The nozzle channel Nfb also has the third portion Pb1 with a width that is large in the Z-axis direction and the fourth portion Pb2 with a width that is small in the Z-axis direction. The nozzle channel Nfa and the nozzle channel Nfb are disposed so that at least part of the first portion Pa1 and the third portion Pb1 do not overlap in the X-axis direction. This prevents the occurrence of structural crosstalk while preventing an increase in channel resistance as in the above embodiments.

Other Embodiments

The configuration of the liquid ejecting head 24 is not limited to the configurations illustrated in the first to seventh embodiments. The liquid ejecting head 24 may have a configuration in which any two or more configurations selected from the configurations illustrated in the first to seventh embodiments are combined such that they do not contradict each other.

Modifications

Having described the embodiments of the present disclosure, it is to be understood that the present disclosure is not limited to the embodiments and various changes may be made. Specific modifications that can be given to the embodiments will be illustrated hereinbelow. Any modification selected from the following examples may be combined as appropriate such that they do not contradict each other.

Figure 28:
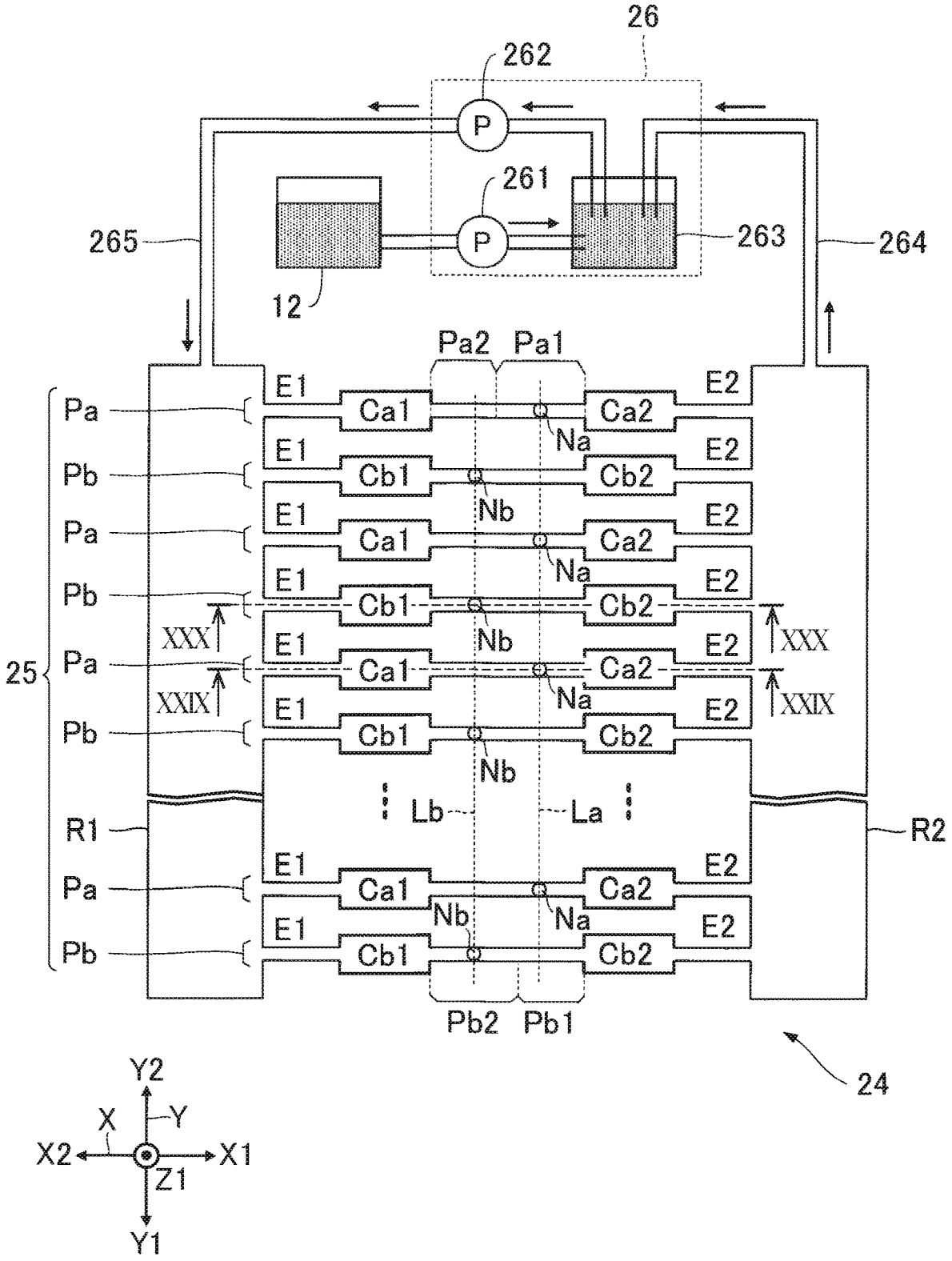
FIG. 28 is a schematic diagram illustrating a channel structure in a liquid ejecting head according to a modification.
Figure 29:
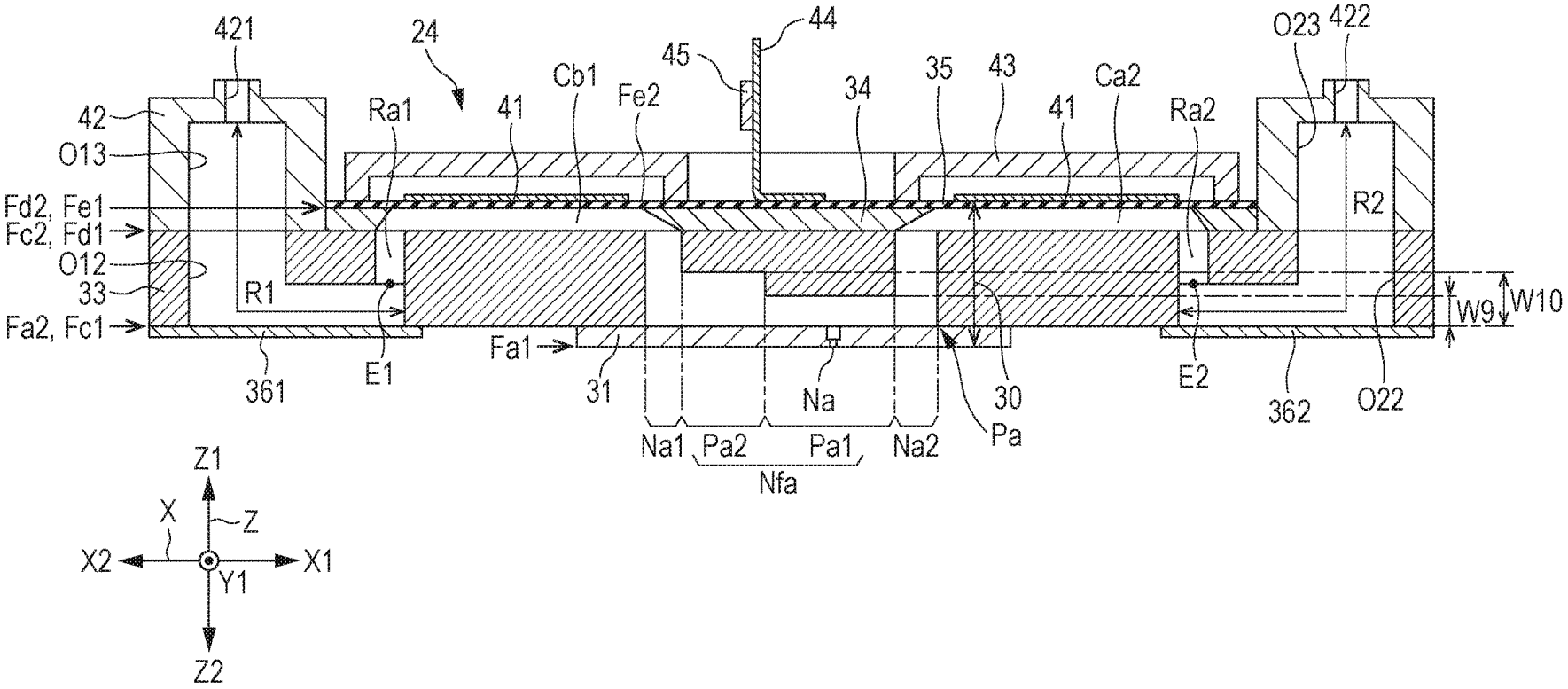
FIG. 29 is a cross-sectional view taken along line XXIX-XXIX in FIG. 28.
Figure 30:
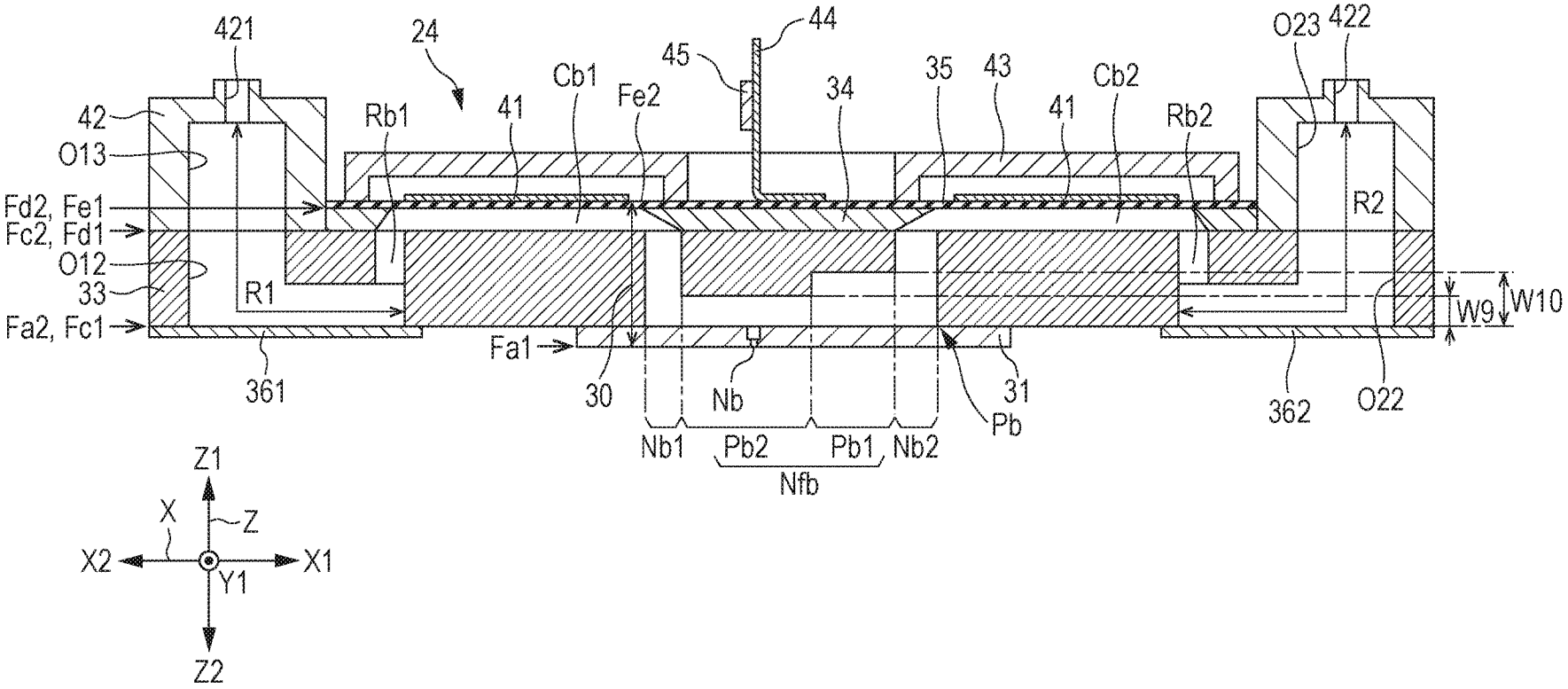
FIG. 30 is a cross-sectional view taken along line XXX-XXX in FIG. 28.

(1) FIG. 28 is a schematic diagram illustrating a channel structure in a liquid ejecting head 24 according to a modification as viewed in the Z-axis direction. FIG. 29 is a cross-sectional view taken along line XXIX-XXIX in FIG. 28. FIG. 30 is a cross-sectional view taken along line XXX-XXX in FIG. 28.

The configuration of the liquid ejecting head 24 is not limited to the configurations of the above embodiments. For example, the first portion Pa1 of the nozzle channel Nfa may communicate with the second communication channel Na2, and the second portion Pa2 may communicate with the first communication channel Na1. Likewise, the third portion Pb1 of the nozzle channel Nfb may communicate with the second communication channel Na2, and the fourth portion Pb2 may communicate with the first communication channel Na1.

(2) The energy generating element that changes the pressure of the ink in the pressure chamber C is not limited to the piezoelectric element 41 illustrated in the above embodiments. For example, the energy generating element may be a heater element that changes the pressure of the ink by generating bubbles in the pressure chamber C by heating. In the configuration in which the heater element is used as the energy generating element, the range of the individual channel P in which bubbles are generated by heating with the heater element is defined as the pressure chamber C.

(3) Although the above embodiments illustrate the serial liquid ejecting apparatus 100 in which the transporter 231 fitted with the liquid ejecting head 24 is moved back and forth, the present disclosure is also applicable to a line liquid ejecting apparatus in which multiple nozzles N are distributed across the entire width of the medium 11.

(4) Although the above embodiments illustrate a case in which the width W1 of the first portion Pa1 in the X1-direction is larger than the width W3 of the second portion Pa2 in the X1-direction, the present disclosure is not limited to the above configuration. In a modification, the width W1 of the first portion Pa1 in the X1-direction may be smaller than the width W3 of the second portion Pa2 in the X1-direction. The width W7 of the fourth portion Pb2 in the X1-direction may be smaller than the width W5 of the third portion Pb1 in the X1-direction. In this case, W1=W7 and W3=W5 may hold. If W1>W3 and W7>W5, as in the above embodiments, the first portion Pa1 and the fourth portion Pb2 do not absolutely overlay in the X-axis direction, reducing the influence of structural crosstalk significantly. In contrast, if W1<W3 and W7<W5, as in this modification, the first portion Pa1 and the fourth portion Pb2 overlap partly in the X-axis direction in the center of the nozzle channel Nfa and the center of the nozzle channel Nfb in the X-axis direction, which is more likely to cause the influence of structural crosstalk than the above embodiments. However, the presence of the second portion Pa2 and the third portion Pb1 reduces the influence of structural crosstalk as compared with the configuration described with reference to FIGS. 9 and 10. Furthermore, in the modification, the distances of the first portion Pa1 and the fourth portion Pb2 in the X-axis direction are longer than those in the above embodiments. This configuration reduces the channel resistance as compared with the above embodiments.

Supplements

The configuration of the liquid ejecting apparatus 100 is not limited to the configurations of the above embodiments. For example, the liquid ejecting apparatus 100 may be a general liquid ejecting apparatus that circulates ink with a configuration other than the configurations of the above embodiments. The liquid ejecting apparatus 100 illustrated in the above embodiments may be employed in apparatuses only for printing and other various apparatuses, such as facsimile machines and copying machines, and the uses of the present disclosure are not particularly limited. The uses of the liquid ejecting apparatus are not limited to printing. For example, liquid ejecting apparatuses that eject solutions of color materials are used as manufacturing apparatuses for forming color filters of display devices, such as liquid-crystal display panels. Liquid ejecting apparatuses that eject a solution of a conductive material are used as manufacturing apparatuses for forming wires and electrodes of wiring substrates. Liquid ejecting apparatuses that eject a solution of an organic substance related to living organisms are used as apparatuses for producing, for example, biochips.

The advantageous effects described in this specification are illustrative only and not restrictive. In other words, the present disclosure can provide the above advantageous effects and/or other advantageous effects which are well known to those skilled in the art from the description of the specification.

Having described preferred embodiments of the present disclosure in detail with reference to the attached drawings, the present disclosure is not limited to the embodiments. It will be obvious to those skilled in the art that various changes and modifications may be made without departing from the technical spirit and scope of the present disclosure and they therefore belong to the technical scope of the present disclosure.

Supplementary Note

The following configuration examples are given from the above illustrated embodiments.

In the present application, "element A and element B overlap in a specific direction" refers to "at least part of element A and at least part of element B overlap with each other as viewed in the specific direction". Not the whole of element A and the whole of element B need to overlap with each other. If at least part of element A and at least part of element B overlap, then it is determined that "element A and element B overlap".

A liquid ejecting head according to an aspect (a first aspect) of the present disclosure includes a first pressure chamber that extends in a first direction and that applies pressure to liquid, a second pressure chamber that extends in the first direction and that applies pressure to the liquid, a first nozzle channel that extends in the first direction and that includes a first nozzle that ejects the liquid. a first communication channel that extends in a second direction intersecting the first direction and that communicates between the first pressure chamber and the first nozzle channel, and a second communication channel that extends in the second direction and that communicates between the second pressure chamber and the first nozzle channel, wherein the first nozzle channel includes a first portion including an end of the first nozzle channel and a second portion including another end of the first nozzle channel, and a width of the second portion in the second direction is larger than a width of the first portion in the second direction. According to this aspect, the structural crosstalk can be reduced while an increase in the channel resistance of the first nozzle channel is prevented.

A liquid ejecting head according to a specific example of the first aspect (a second aspect) further includes a third pressure chamber that extends in the first direction and that applies pressure to the liquid, a fourth pressure chamber that extends in the first direction and that applies pressure to the liquid, a second nozzle channel that extends in the first direction and that includes a second nozzle that ejects the liquid, a third communication channel that extends in the second direction and that communicates between the third pressure chamber and the second nozzle channel, and a fourth communication channel that extends in the second direction and that communicates between the fourth pressure chamber and the second nozzle channel, wherein the second nozzle channel includes a third portion including an end of the second nozzle channel and a fourth portion including another end of the second nozzle channel, and a width of the fourth portion in the second direction is smaller than a width of the third portion in the second direction. According to this aspect, the structural crosstalk can be reduced while an increase in the channel resistance of the first nozzle channel and the second nozzle channel is prevented.

According to a specific example of the second aspect (a third aspect), the first nozzle and the second nozzle are at a same position in the first direction.

According to a specific example of the third aspect (a fourth aspect), the first nozzle channel and the second nozzle channel are adjacent to each other in a third direction intersecting the first direction and the second direction.

According to a specific example of one of the second to fourth aspects (a fifth aspect), the first portion and the third portion overlap at least partly in the first direction, and the second portion and the fourth portion overlap at least partly in the first direction. According to this aspect, even if a vibration due to ink flow is generated in the third portion, the vibration is less likely to be transmitted to the first portion because the first portion is not present at the position overlapping with the third portion in the third direction, reducing the influence on the ejection from the first nozzle. In other words, structural crosstalk is unlikely to occur. Likewise, since the fourth portion is not present at the position overlapping with the second portion in the third direction, a vibration from the second portion is less likely to be transmitted to the fourth portion, reducing the possibility of structural crosstalk.

According to a specific example of the fifth aspect (a sixth aspect), the third portion overlaps entirely with the first portion in the first direction, and the second portion overlaps entirely with the fourth portion in the first direction.

According to a specific example of one of the second to sixth aspects (a seventh aspect), the width of the fourth portion in the second direction is equal to the width of the first portion in the second direction.

According to a specific example of one of the second to seventh aspects (an eighth aspect), the width of the third portion in the second direction is equal to the width of the second portion in the second direction.

According to a specific example of one of the second to eighth aspects (a ninth aspect), a width of the third portion in the first direction is equal to a width of the second portion in the first direction, and a width of the fourth portion in the first direction is equal to a width of the first portion in the first direction.

The liquid ejecting head according to a specific example of one of the second to ninth aspects (a tenth aspect) further includes a first individual supply channel that communicates with the first pressure chamber and that supplies the liquid to the first pressure chamber, a second individual supply channel that communicates with the third pressure chamber and that supplies the liquid to the third pressure chamber, a common supply channel that supplies the liquid, in common, to the first individual supply channel and the second individual supply channel, a first individual discharge channel that communicates with the second pressure chamber and that receives the liquid discharged from the second pressure chamber, a second individual discharge channel that communicates with the fourth pressure chamber and that receives the liquid discharged from the fourth pressure chamber, and a common discharge channel that receives the liquid, in common, discharged from the first individual discharge channel and the second individual discharge channel.

According to a specific example of the tenth aspect (an eleventh aspect), the first portion communicates with the first communication channel, and the second portion communicates with the second communication channel.

According to a specific example of the tenth aspect (a twelfth aspect), the first portion communicates with the second communication channel, and the second portion communicates with the first communication channel.

According to a specific example of one of the first to twelfth aspects (a thirteenth aspect), the width of the second portion in the second direction is larger three times the width of the first portion in the second direction.

According to a specific example of one of the first to thirteenth aspects (a fourteenth aspect), a width of the second portion in a third direction intersecting the first direction and the second direction is smaller than a width of the first portion in the third direction.

According to a specific example of one of the first to fourteenth aspects (a fifteenth aspect), assuming that a side on which the first pressure chamber and the second pressure chamber are positioned in the second direction as viewed from the first nozzle channel is a first side and that a side on which the first nozzle is positioned in the second direction is a second side, a channel wall surface of the first portion on the second side and a channel wall surface of the second portion on the second side are at a same position in the second direction, and a channel wall surface of the first portion on the first side and a channel wall surface of the second portion on the first side are at different positions in the second direction.

According to a specific example of one of the first to fourteenth aspects (a sixteenth aspect), assuming that a side on which the first pressure chamber and the second pressure chamber are positioned in the second direction as viewed from the first nozzle channel is a first side and that a side on which the first nozzle is positioned in the second direction is a second side, a channel wall surface of the first portion on the second side and a channel wall surface of the second portion on the second side are at different positions in the second direction, and a channel wall surface of the first portion on the first side and a channel wall surface of the second portion on the first side are at a same position in the second direction.

According to a specific example of one of the first to sixteenth aspects (a seventeenth aspect), the width of the second portion in the first direction is smaller than the width of the first portion in the first direction.

According to a specific example of one of the first to sixteenth aspects (an eighteenth aspect), the width of the second portion in the first direction is larger than the width of the first portion in the first direction.

According to a specific example of one of the first to eighteenth aspects (a nineteenth aspect), the first nozzle is disposed in the first portion.

According to a specific example of one of the first to eighteenth aspects (a twentieth aspect), the first nozzle is disposed in the second portion.

The liquid ejecting head according to a specific example of one of the first to twentieth aspects (a twenty-first aspect) further includes a first energy generating element that generates energy for applying pressure to the liquid in the first pressure chamber by receiving a drive voltage and a second energy generating element that generates energy for applying pressure to the liquid in the second pressure chamber by receiving a drive voltage.

A liquid ejecting apparatus according to an aspect (a twenty-second aspect) of the present disclosure includes the liquid ejecting head according to any one of the first to twenty-first aspects and a control section that controls an ejecting operation of the liquid ejecting head.

What is claimed is:

1. A liquid ejecting head comprising:

a first pressure chamber that extends in a first direction and that applies pressure to liquid;

a first nozzle channel that extends in the first direction and that communicates a first nozzle that ejects the liquid; and a first communication channel that extends in a second direction intersecting the first direction and that communicates between the first pressure chamber and the first nozzle channel; wherein the first nozzle channel includes a first portion including an end of the first nozzle channel and a second portion including another end of the first nozzle channel, and a width of the second portion in the second direction is larger than a width of the first portion in the second direction.

2. The liquid ejecting head according to claim 1, further comprising:

a second pressure chamber that extends in the first direction and that applies pressure to the liquid;

a second nozzle channel that extends in the first direction and that communicates a second nozzle that ejects the liquid; and a second communication channel that extends in the second direction and that communicates between the second pressure chamber and the second nozzle channel; wherein the second nozzle channel includes a third portion including an end of the second nozzle channel and a fourth portion including another end of the second nozzle channel, and a width of the fourth portion in the second direction is smaller than a width of the third portion in the second direction.

3. The liquid ejecting head according to claim 2, wherein the first nozzle and the second nozzle are at a same position in the first direction.

4. The liquid ejecting head according to claim 2, wherein the first nozzle channel and the second nozzle channel are adjacent to each other in a third direction intersecting the first direction and the second direction.

5. The liquid ejecting head according to claim 2, wherein the first portion and the third portion overlap at least partly in the first direction, and the second portion and the fourth portion overlap at least partly in the first direction.

6. The liquid ejecting head according to claim 5, wherein the third portion overlaps entirely with the first portion in the first direction, and the second portion overlaps entirely with the fourth portion in the first direction.

7. The liquid ejecting head according to claim 2, wherein the width of the fourth portion in the second direction is equal to the width of the first portion in the second direction.

8. The liquid ejecting head according to claim 2, wherein the width of the third portion in the second direction is equal to the width of the second portion in the second direction.

9. The liquid ejecting head according to claim 2, wherein a width of the third portion in the first direction is equal to a width of the second portion in the first direction, and a width of the fourth portion in the first direction is equal to a width of the first portion in the first direction.

10. The liquid ejecting head according to claim 2, further comprising:

a first individual channel that includes the first pressure chamber, the first nozzle channel and the first communication channel;

a second individual channel that includes the second pressure chamber, the second nozzle channel and the second communication channel;

a common supply channel that supplies the liquid, in common, to the first individual channel and the second individual channel; and a common discharge channel that receives the liquid, in common, discharged from the first individual channel and the second individual channel.

11. The liquid ejecting head according to claim 10, wherein when seeing along the second direction, the first nozzle channel and the second nozzle channel are positioned between the common supply channel and the common discharge channel in the first direction.

12. The liquid ejecting head according to claim 11, wherein the first portion is supply side and the second portion is discharge side in the first nozzle channel.

13. The liquid ejecting head according to claim 11, wherein the first portion is discharge side and the second portion is supply side in the first nozzle channel.

14. The liquid ejecting head according to claim 1, wherein the width of the second portion in the second direction is larger three times the width of the first portion in the second direction.

15. The liquid ejecting head according to claim 1, wherein the width of the second portion in the first direction is smaller than the width of the first portion in the first direction.

16. The liquid ejecting head according to claim 1, wherein the width of the second portion in the first direction is larger than the width of the first portion in the first direction.

17. The liquid ejecting head according to claim 1, wherein the first nozzle is disposed in the first portion.

18. The liquid ejecting head according to claim 1, wherein the first nozzle is disposed in the second portion.

19. A liquid ejecting apparatus comprising:

the liquid ejecting head according to claim 1; and a control section that controls an ejecting operation of the liquid ejecting head.

* * * * *